US010982447B2

(12) United States Patent
Sager

(10) Patent No.: US 10,982,447 B2
(45) Date of Patent: Apr. 20, 2021

(54) DIVERTER WITH FILTERING MESH

(71) Applicant: Karen M. Sager, Ridgewood, NJ (US)

(72) Inventor: Karen M. Sager, Ridgewood, NJ (US)

( * ) Notice: Subject to any disclaimer, the term of this patent is extended or adjusted under 35 U.S.C. 154(b) by 105 days.

(21) Appl. No.: 16/251,349

(22) Filed: Jan. 18, 2019

(65) Prior Publication Data

US 2019/0352912 A1 Nov. 21, 2019

Related U.S. Application Data

(60) Provisional application No. 62/673,735, filed on May 18, 2018.

(51) Int. Cl.
*E04D 13/076* (2006.01)

(52) U.S. Cl.
CPC ..... *E04D 13/076* (2013.01)

(58) Field of Classification Search
CPC ..... E04D 13/0459; E04D 13/0481; E04D 13/076; E04D 2013/0454; E04D 2013/0463; E04D 2013/0486
USPC ..... 52/13, 15
See application file for complete search history.

(56) References Cited

U.S. PATENT DOCUMENTS 116,072 A * 6/1871 Lockwood ..... E04D 13/064 52/15
3,665,663 A * 5/1972 Scherer ..... E04D 13/0459 52/95
6,412,229 B2 * 7/2002 Kuhns ..... E04D 13/076 52/11
6,598,352 B2 7/2003 Higginbotham
6,951,077 B1 10/2005 Higginbotham
7,174,688 B2 2/2007 Higginbotham
7,191,564 B2 3/2007 Higginbotham
7,765,743 B2 * 8/2010 Guilford ..... E04D 13/076 210/474
7,913,458 B2 3/2011 Higginbotham
7,946,081 B1 * 5/2011 Frederick ..... E04D 13/064 248/48.1
7,987,634 B2 * 8/2011 Bailey ..... E04D 13/076 249/49
8,006,438 B2 8/2011 Higginbotham
RE42,896 E 11/2011 Higginbotham
RE43,555 E 7/2012 Higginbotham
(Continued)

FOREIGN PATENT DOCUMENTS

DE 10332747 B3 * 11/2004 ..... E04D 13/0725
DE 102004043349 A1 * 3/2006 ..... E04D 13/076
WO WO-8903465 A1 * 4/1989 ..... E04D 13/103

*Primary Examiner* — Christine T Cajilig
(74) *Attorney, Agent, or Firm* — Stuart I. Smith; Roberts Calderon Safran & Cole. P.C.

(57) ABSTRACT

A water diverter for diverting water on a building roof or gutter is provided. The diverter includes a main body having a first portion having a top side and a bottom side, a diverting portion extending from the top side of the first portion at a first angle, the first angle being an angle greater than zero degrees, and an attachment portion extending from the first portion and being configured to attach to the building roof or gutter; a first opening in one of the first portion and the diverting portion, the first opening being configured to allow the water to pass through the one of the first portion and the diverting portion; and a filter element positioned above the first portion of the main body and through which the water can pass.

20 Claims, 36 Drawing Sheets

(56) References Cited

U.S. PATENT DOCUMENTS

| | | | | |
|---|---|---|---|---|
| 8,312,677 | B2 | 11/2012 | Higginbotham | |
| 8,397,436 | B2 | 3/2013 | Higginbotham | |
| 8,720,123 | B1 * | 5/2014 | Katiraei | E04D 13/0445 52/15 |
| 9,010,029 | B2 | 4/2015 | Higginbotham | |
| 9,115,497 | B2 * | 8/2015 | Morris | E04D 13/0767 |
| 2003/0046876 | A1 | 3/2003 | Higginbotham | |
| 2004/0031222 | A1 | 2/2004 | Porat | |
| 2004/0255522 | A1 * | 12/2004 | Knudson | E04D 13/0459 52/11 |
| 2006/0248805 | A1 | 11/2006 | Gentry | |
| 2007/0055007 | A1 | 3/2007 | Pagel et al. | |
| 2007/0068092 | A1 | 3/2007 | Fraser, Jr. | |
| 2009/0000210 | A1 | 1/2009 | Barnett | |
| 2009/0288349 | A1 | 11/2009 | Wootton | |
| 2010/0251626 | A1 | 10/2010 | Roque Alonso | |
| 2011/0252723 | A1 | 10/2011 | Devery | |
| 2011/0308557 | A1 | 12/2011 | Kaiser | |
| 2015/0218827 | A1 * | 8/2015 | Alleger | E04D 13/0459 52/11 |
| 2017/0152661 | A1 * | 6/2017 | White | E04D 13/0643 |
| 2017/0342716 | A1 * | 11/2017 | Sinclair | E04D 13/0481 |
| 2018/0179761 | A1 * | 6/2018 | Higginbotham | E04D 13/076 |

* cited by examiner

6A

6B

6C

6D

6E

6F

6G

6H

6I

6J

6K

6L

6M

6N

6O

6P

6Q

6R

6S

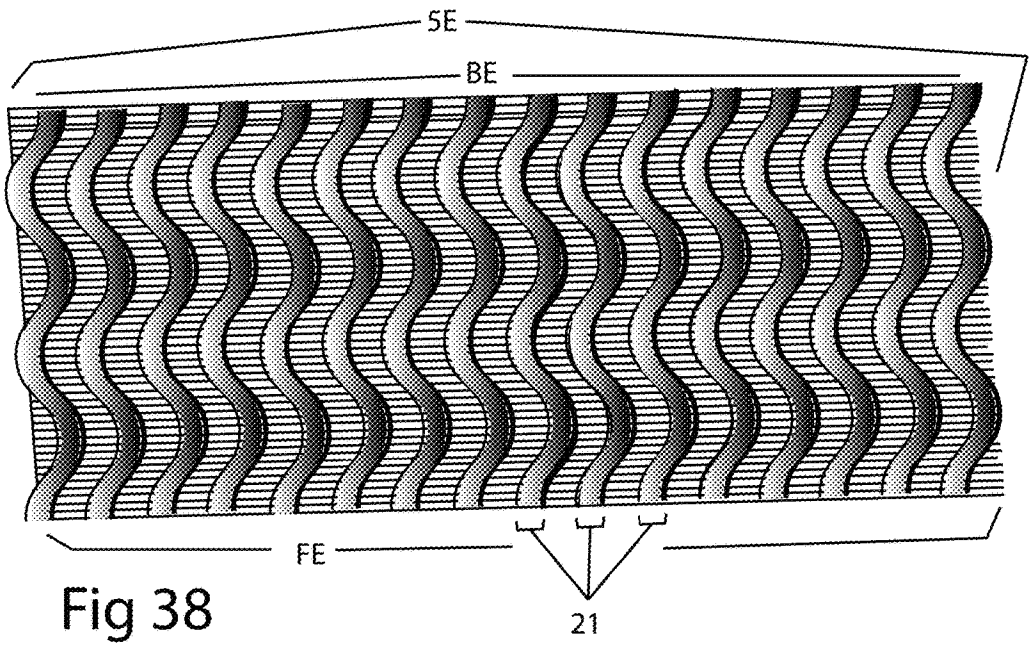
Fig 38
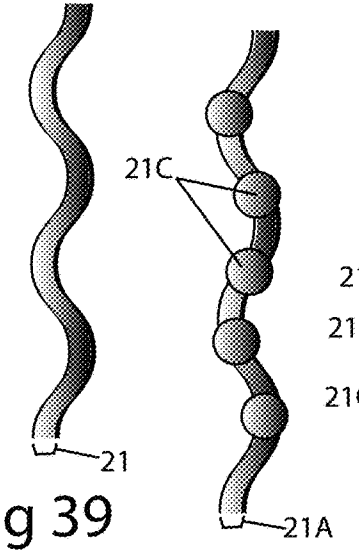
Fig 39
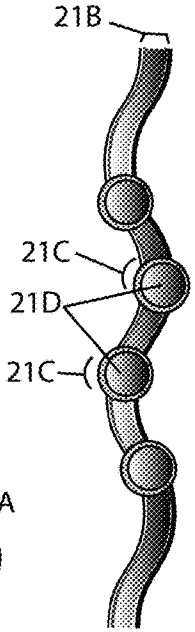
Fig 40
Fig 41
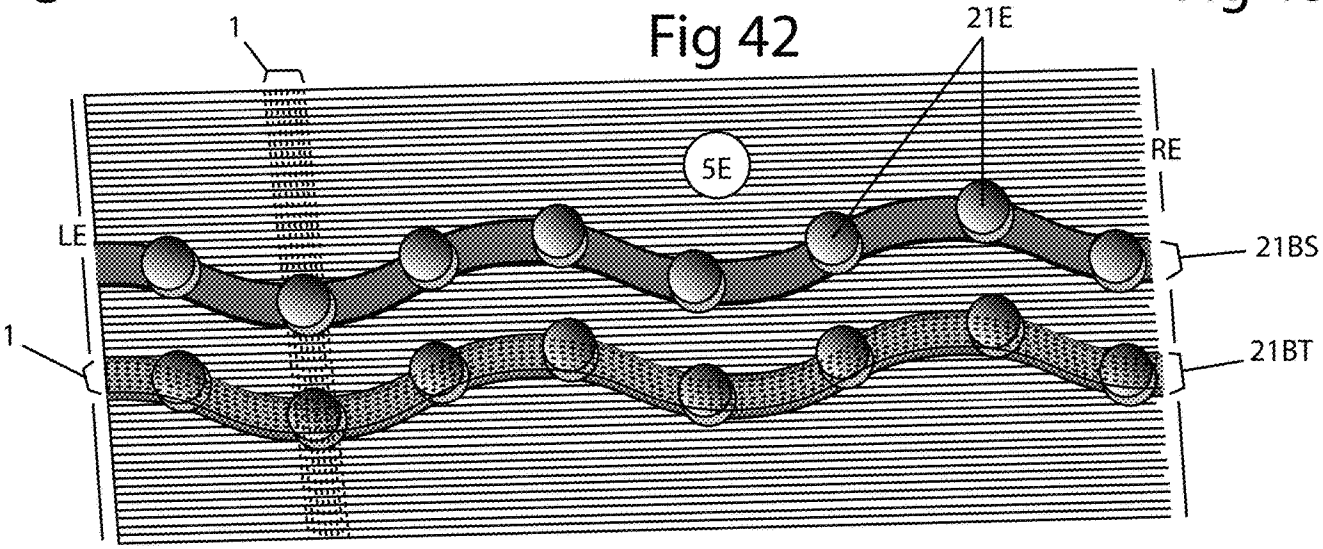
Fig 42

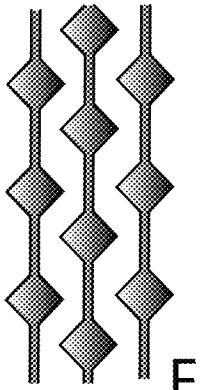
Fig 43
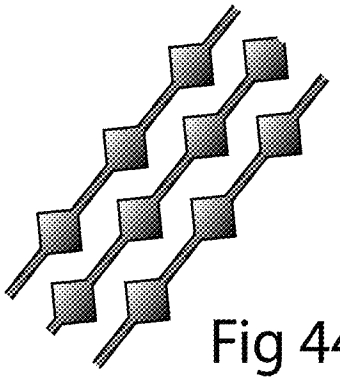
Fig 44
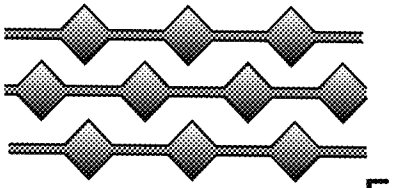
Fig 45
Moss Guard
Fig 46
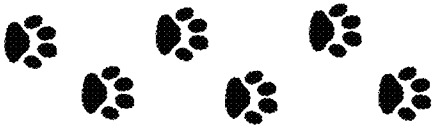
Fig 47
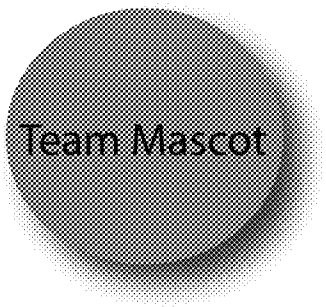
Fig 48
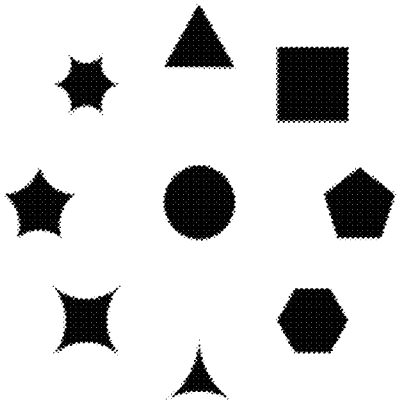
Fig 49

DIVERTER WITH FILTERING MESH

FIELD

The present invention relates generally to meshes and other water-permeable surfaces. More specifically, particular embodiments of the invention relate to water diverters with filtering mesh. Particular embodiments of the invention relate to a filtering mesh having protrusions.

BACKGROUND

This application claims the benefit of U.S. Provisional Patent Application No. 62/673,735 filed May 18, 2018, which is incorporated by reference herein in its entirety.

Many homes and other buildings have gutters that collect rain water and divert the collected rain water downward to the ground or other surfaces. Leaves and other debris can accumulate in the gutters either from being directly deposited into the gutters or from being washed off of or otherwise moved from the roof to the gutter.

In addition, there are often places on a roof where rainwater flows at a higher velocity and/or volume due to the configuration of the roof. In some cases, this increased velocity and/or volume leads to the rain water overshooting the gutter which is intended to catch the rain water.

A problem exists in that the above-mentioned debris can accumulate to the point of blocking the gutter and causing the water to overflow an edge of the gutter instead of flow through the gutter as designed. Various devices have been created in an attempt to prevent the clogging of gutters. Most of these devices do not prevent clogging in a satisfactory manner.

Accordingly, improved systems and methods for preventing the clogging of gutters are needed.

SUMMARY

Embodiments of the invention address the above-described problem of rain water overshooting the gutter by controlling and/or partially redirecting the velocity and/or volume of rain water flowing down the roof.

In one aspect, a water diverter for diverting water on a building roof or gutter includes a main body having a first portion having a top side and a bottom side, a diverting portion extending from the top side of the first portion at a first angle, the first angle being an angle greater than zero degrees, and an attachment portion extending from the first portion and being configured to attach to the building roof or gutter; a first opening in one of the first portion and the diverting portion, the first opening being configured to allow the water to pass through the one of the first portion and the diverting portion; and a filter element positioned above the first portion of the main body and through which the water can pass.

In another aspect, a water diverter for diverting water on a building roof or gutter includes a main body having an attachment portion having a top side and a bottom side, the attachment portion being configured to attach to the building roof or gutter, and a diverting portion extending from the top side of the attachment portion at a first angle, the first angle being an angle greater than zero degrees; and a filter element positioned above the attachment portion and through which the water can pass.

In another aspect, a roof for a building includes a first roof surface; and a diverter having a main body having a first portion having a top side and a bottom side, the bottom side resting on the first roof surface, a diverting portion extending from the top side of the first portion at a first angle, the first angle being an angle greater than zero degrees, and an attachment portion extending from the first portion and attached to the roof, and a filter element positioned above the first portion of the main body and through which the water can pass.

In another aspect, a water diverter for diverting water on a building roof includes a main body having a first portion having a top side and a bottom side, a diverting portion extending from the top side of the first portion at a first angle, the first angle being an angle greater than zero degrees, and an attachment portion extending from the first portion and being configured to attach to the building roof; a plurality of openings in the first portion, the plurality of openings being configured to allow the water to pass through the first portion from the top side; and a screen positioned above the first portion of the main body and through which the water can pass, the screen having a top side, a bottom side, and a plurality of members that form the screen. The screen is separated from the top side of the main body by an air space for at least a portion of the top side of the main body.

In another aspect, a water diverter for diverting water on a building roof includes a main body having an attachment portion having a top side and a bottom side, the attachment portion being configured to attach to the building roof, and a diverting portion extending from the top side of the attachment portion at a first angle, the first angle being an angle greater than zero degrees; and a screen positioned above the attachment portion and through which the water can pass, the screen having a top side, a bottom side, and a plurality of members that form the screen. The screen is separated from the top side of the attachment portion by an air space for at least a portion of the top side of the attachment portion.

In another aspect, a roof for a building includes a first row of shingles having a lower edge that is substantially linear; a second row of shingles partially overlapping the first row of shingles, the second row of shingles having a lower edge that is substantially parallel to the lower edge of the first row of shingles; and a diverter having a main body having a first portion having a top side and a bottom side, the bottom side resting on a shingle in the first row of shingles, a diverting portion extending from the top side of the first portion at a first angle, the first angle being an angle greater than zero degrees, and an attachment portion extending from the first portion and attached to the roof, and a screen positioned above the first portion of the main body and through which the water can pass, the screen having a top side, a bottom side, and a plurality of members that form the screen. The screen is separated from the top side of the main body by an air space for at least a portion of the top side of the main body.

Further areas of applicability of the present invention will become apparent from the detailed description provided hereinafter. It should be understood that the detailed description and specific examples, while indicating preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 38 is a plan view of a screen in accordance with exemplary embodiments of the invention, having a non-linear shape;

FIG. 39 is a side view of the screen of FIG. 38;

FIG. 40 is a side view of the screen of FIG. 38;

FIG. 41 is a side view of the screen of FIG. 38;

FIG. 42 is a plan view of a screen in accordance with embodiments of the invention;

FIG. 43 shows an example of a pattern incorporated into a screen in accordance with exemplary embodiments of the invention;

FIG. 44 shows an example of a pattern incorporated into a screen in accordance with exemplary embodiments of the invention;

FIG. 45 shows an example of a pattern incorporated into a screen in accordance with exemplary embodiments of the invention;

FIG. 46 shows an example of a pattern incorporated into a screen in accordance with exemplary embodiments of the invention;

FIG. 47 shows an example of a pattern incorporated into a screen in accordance with exemplary embodiments of the invention;

FIG. 48 shows an example of a pattern incorporated into a screen in accordance with exemplary embodiments of the invention;

FIG. 49 shows an example of a pattern incorporated into a screen in accordance with exemplary embodiments of the invention;

Figure 1:
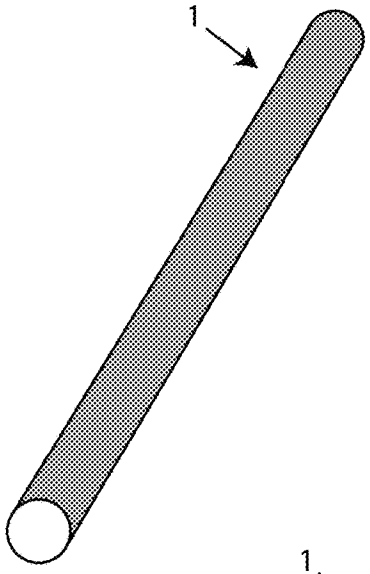
FIG. 1 is a perspective view of a wire.

All drawings are schematic and not necessarily to scale. Parts given a reference numerical designation in one figure may be considered to be the same parts where they appear in other figures without a numerical designation for brevity unless specifically labeled with a different part number and described herein.

DETAILED DESCRIPTION

The following description of the preferred embodiment(s) is merely exemplary in nature and is in no way intended to limit the invention, its application, or uses.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "connected," "coupled," "interconnected," and similar refer to a relationship wherein structures are secured or attached to one another either directly or indirectly through intervening structures, as well as both movable or rigid attachments or relationships, unless expressly described otherwise. The term "fixed" refers to two structures that cannot be separated without damaging one of the structures. The term "filled" refers to a state that includes completely filled or partially filled in a solid or non-solid state.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

While the example of a gutter guard to prevent clogging of a rain gutter is used to describe embodiments of the invention, it is noted that the invention also applies to other filtering applications such as, for example, filtering drinkable liquids, and filtering any liquid that is improved by killing moss, mold, mildew, algae, lichen, microbes, bacteria, viruses, germs, the detoxification of toxic elements, and/or the reduction of harmful radiation.

As stated above, a problem exists in that debris can accumulate to the point of blocking the gutter and causing the water to overflow an edge of the gutter instead of flow through the gutter as designed. This debris can include, for non-limiting example, leaves, parts of leaves, seeds, seed pods, other tree material, moss, spores and other products from organisms growing on roofs, material from decaying roof shingles, etc. A mesh screen can be used to block debris from entering the gutter. Embodiments of the invention, examples of which are described in more detail below, provide one or more wires or threads of a metal or other material that is a different material from the material of the screen. In embodiments, this wire or thread acts as a growth inhibiting material to prevent growth on the screen. As described below, the growth inhibiting material can, itself, over time cause a partial blockage of the screen. Embodiments of the invention provide a solution to a problem caused by this growth.

This description describes several exemplary embodiments of the invention. Many of these embodiments include copper wire, or copper element(s) having a variety of shapes. One or more of certain properties of copper, namely, for example, the ability to prevent or kill moss, mold, mildew, algae, lichen, microbes, bacteria, viruses, germs, and/or the ability to detoxify toxic elements and/or render harmless harmful radiations, are advantageously used in embodiments of the invention. An example of such a material is bacteria killing ceramics. For simplicity and clarity, it is understood that when the term "copper" is used in this disclosure, other metals and other materials having properties or made to have properties able to prevent or kill moss, mold, mildew, algae, lichen, microbes, bacteria, viruses, germs, and/or the ability to detoxify toxic elements and/or render harmless harmful radiations can also be used. In addition to the term "copper", the terms "growth inhibiting wire", "growth inhibiting thread", "growth inhibiting element", or "growth inhibiting material" is used in this disclosure to represent copper and/or any other material that inhibits growth and/or has one or more of the exemplary properties listed above.

In this disclosure, the term "wire" is understood to also include thread or other elongated structures; the term "oxidation" is understood to include redox reaction, efflorescence and cupric chloride; the term "ribbon" is understood to mean any material with more length than width and capable of flexing; the term "screen" is understood to also include any structure, barrier, cloth, material or method able to prevent the passing of at least one element while allowing one or more other elements to pass through the body of the screen; also included in the invention is any structure, material or method able to change the property of any liquid, gas, moss, mold, mildew, algae, lichen, microbes, bacteria, poison, toxin, radiation, virus or germ that passes through it; and the term "shape" is understood to also include graphical representations of words, letters, phrases, logos, lines, numbers, etc. The term "mechanical waterproofing" is understood to mean a property of water flow that occurs when water contacts a solid or somewhat solid surface where the angle of such surface is in close proximity to the angle of any screen the solid or somewhat solid surface immediately precedes. When this takes place, the water that would normally drop down through a screen (under the force of gravity) will, instead, continue to flow across the screen until it reaches the screen's terminal edge unless the forward flow is interrupted by a feature designed to direct water downward through the screen's open air spaces.

Figure 2:
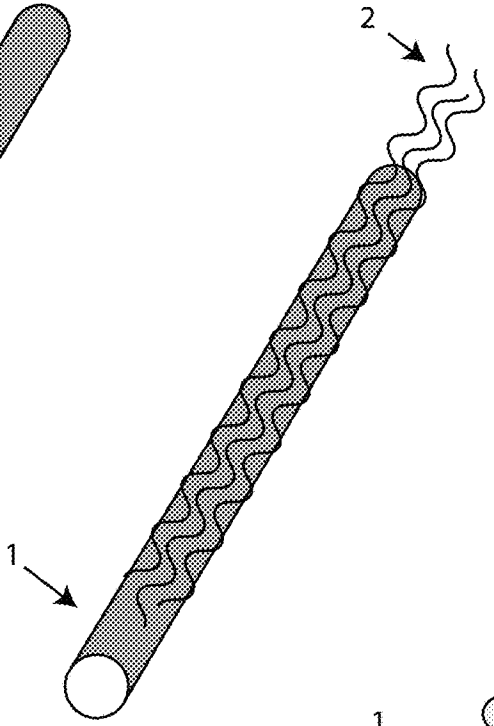
FIG. 2 is a perspective view of a wire illustrating water flow paths.
Figure 3:
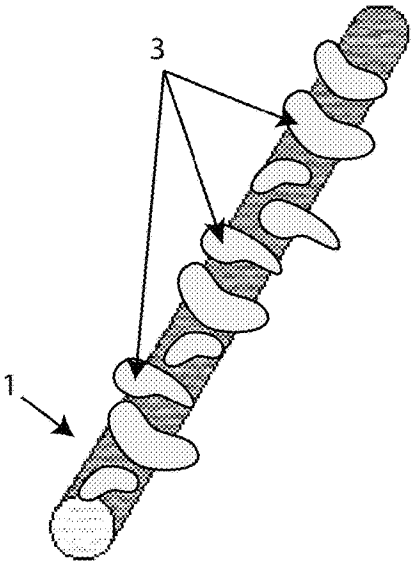
FIG. 3 is a perspective view of a wire illustrating an example of build-up present on a wire.
Figure 4:
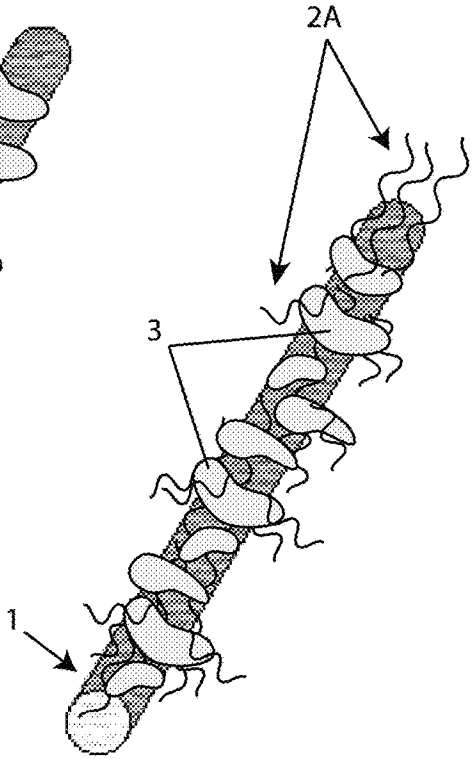
FIG. 4 is a perspective view of a wire illustrating water flow paths being changed by build-up on a wire.

FIG. 1 shows a wire 1 that can be a copper wire. FIG. 2 shows wire 1 being contacted by water 2 that flows forward along the surface of wire 1. FIG. 3 shows wire 1 having oxidation particles 3 forming on wire 1 which may cause water 2 to cease flowing forward in a mostly or completely uniform manner and begin flowing, as shown in FIG. 4, in random directions, represented by 2A. Such oxidation 3 occurs in some situations in environments or when copper contacts or is in close proximity to metals or materials that have an anodic numerical difference greater than 0.15 volts than that of copper.

Figure 8:
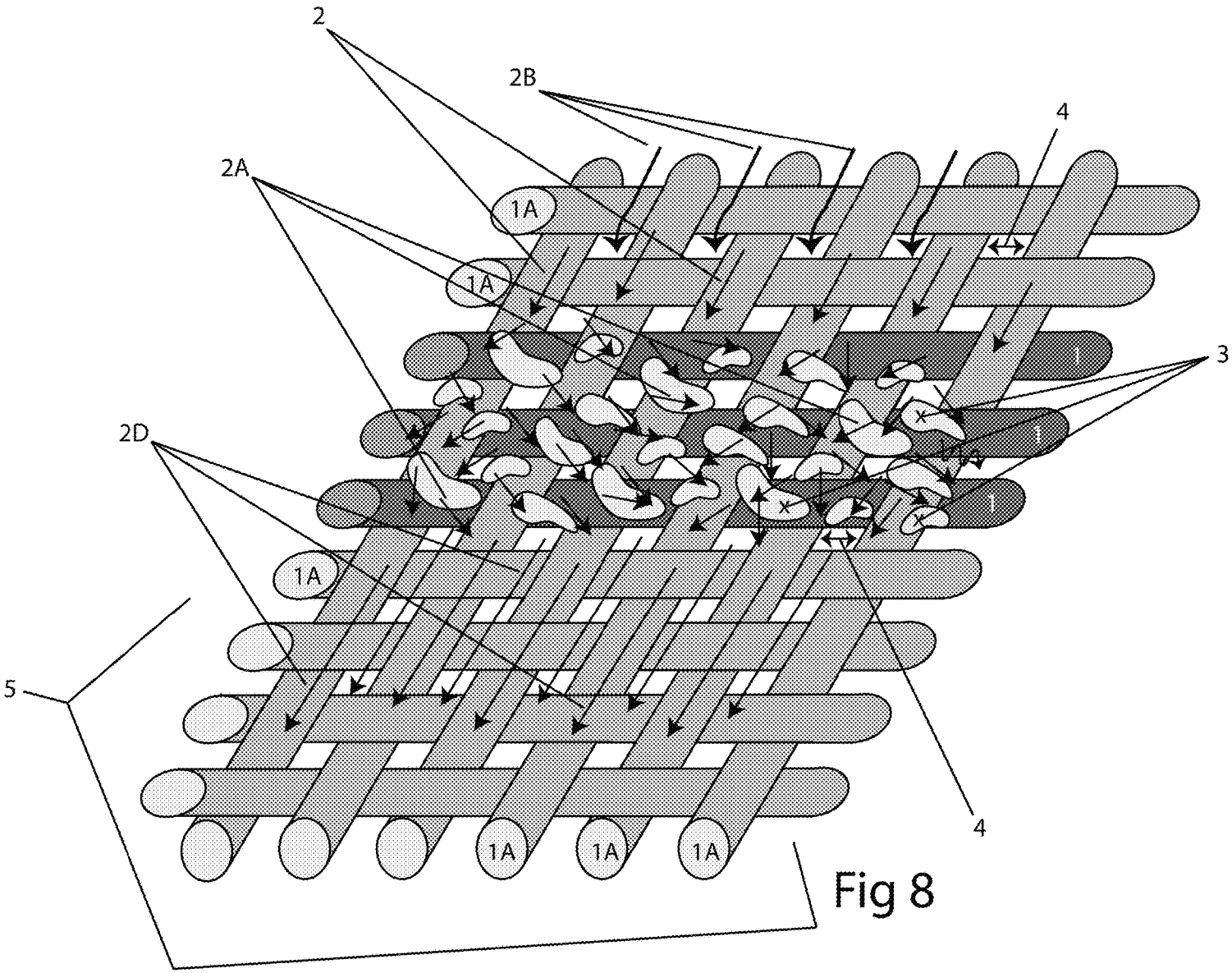
FIG. 8 is a perspective view of a screen.

FIG. 8 shows a screen 5 that includes copper threads 1 and stainless steel or other material threads 1A. Forward flowing water following mostly uniform flow paths 2 are shown becoming random flow paths 2A as they contact and become impeded by oxidation particles and powder 3 which often form with a granular or rough texture which diverts the water into random flow paths 2A. Threads 1A initially slow the forward flow of water and redirects the water down (as shown by arrows 2B) through open air spaces 4 existing between threads 1, 1A of screen 5. However, this redirection of the water, in some cases, is not sustained along the entire screen 5. Water 2D that passes by the oxidation particles and powder 3 and does not penetrate screen 5 continues along the top of screen 5. In embodiments, the screen is a perforated metal, or other material, sheet such as, for example, a punched metal or expanded metal.

While in some embodiments threads 1 and 1A take the form discussed above, in other embodiments threads 1 are larger and/or harder threads and/or a braid of threads as compared to smaller, softer, and/or other material threads 1A. In various embodiments and examples discussed herein, copper threads/wires 1 can be replaced with larger or harder threads or a braid of threads as compared to smaller or other material threads 1A. In still other embodiments, threads 1A can be larger and/or harder threads and/or one or more braids of threads as compared to smaller, softer, and/or other material threads 1.

Figure 6:
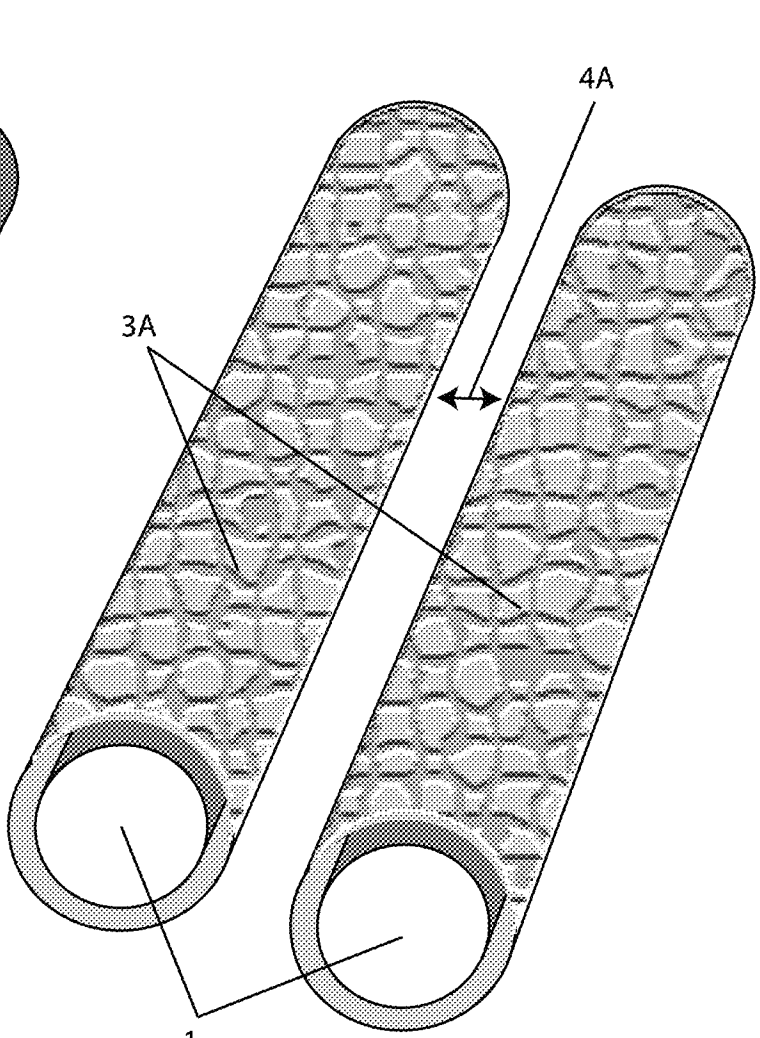
FIG. 6 is a perspective view of two wires coated with build-up.
Figure 5:
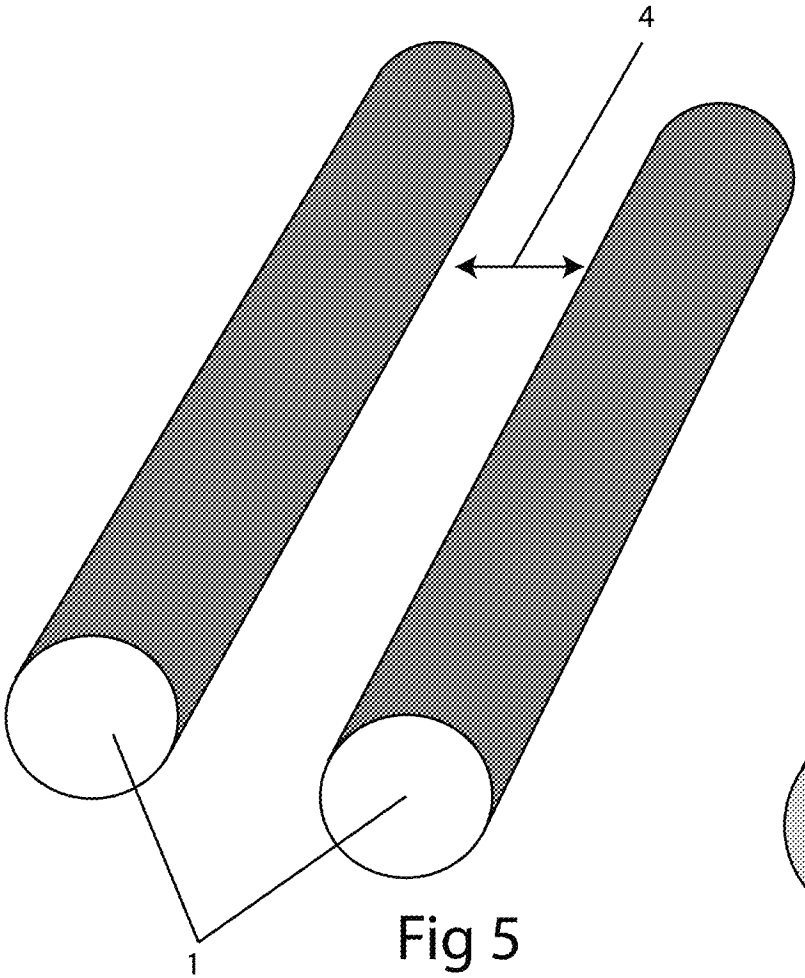
FIG. 5 is a perspective view of two wires illustrating an open air space between the wires.
Figure 7:
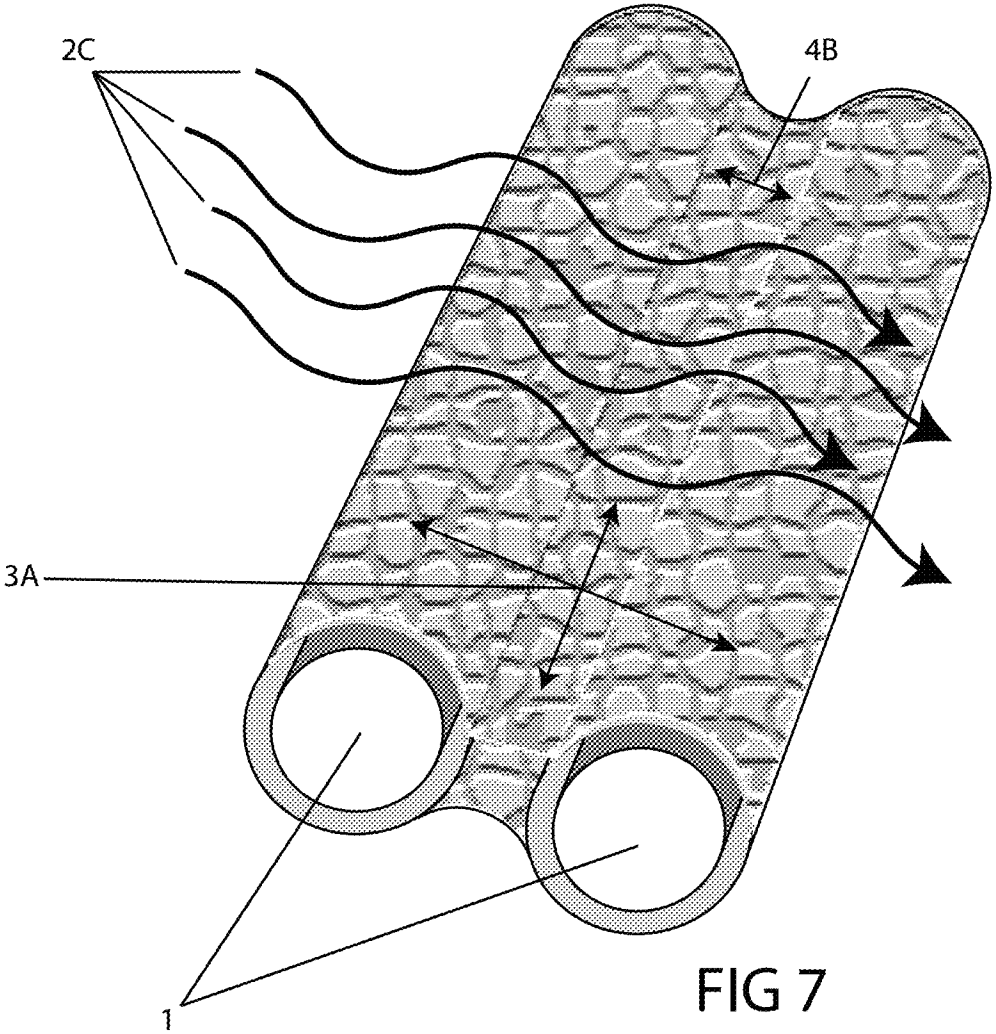
FIG. 7 is a perspective view of two wires coated with build-up.

FIGS. 5-7 show two copper wires 1 adjacent to one another and show a progressive formation of oxidation 3A occurring. FIG. 5 shows no oxidation 3A and an air space 4 between the two wires 1. FIG. 6 shows oxidation 3A increasing as it begins to completely coat wires 1 and narrows air space 4 to a smaller air space 4A. FIG. 7 shows that oxidation 3A can eventually fill the formerly open air space 4, 4A between wires 1 forming an oxidation "mat" 3A with the result that water flow 2C is no longer directed downward through open air spaces or impeded by individual oxidation particles. Instead, water flow 2C transitions forward across the oxidation mat 3A that has coated the top surface of the screen 5 wires 1 and filled in the open air space between them (indicated by 4B).

Figure 8A:
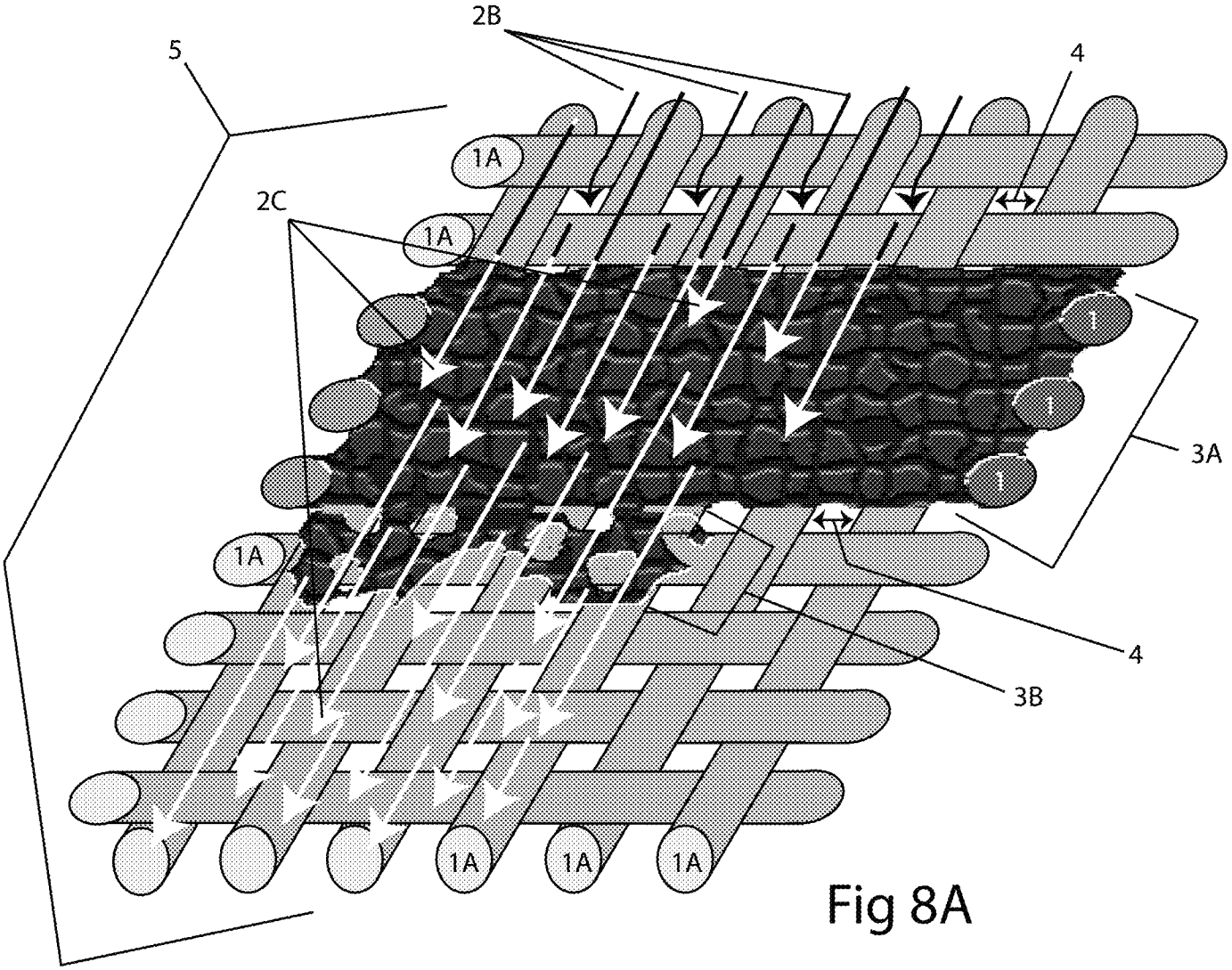
FIG. 8A is a perspective view of the screen of FIG. 8 having portions blocked by build-up.

FIG. 8A shows a screen 5 having an area of the screen covered by oxidation particles that have congregated into oxidation mat 3A and partial oxidation mat 3B. This demonstrates how oxidation, once it builds and/or congeals, causes an effect that is referred to as mechanical waterproofing. Water 2B that would normally flow downward through open air spaces 4 will begin to bypass open air spaces 4 and continue flowing forward once the water 2C has contacted any solid or partially solid surface (such as oxidation mat 3A and partial oxidation mat 3B) which now covers both wires 1, 1A and open air spaces 4 between wires 1, 1A. The inventor discovered that if such solid or mostly solid surfaces (such as 3A, 3B) are in the same or nearly the same plane as a successive (downstream) area of uncoated or un-matted screen, the water 2C will bypass all or mostly all of the open air spaces it encounters until reaching the terminal edge of the screen. This effect renders gutter guards employing screens as their water receiving areas impermeable to water penetration. Although water 2C may have acquired copper properties by passing over the copper infused oxidation mats 3A, 3B, screen 5 is no longer able to direct water downward through open air spaces 4 present within screen 5 into an underlying rain gutter. This mechanical waterproofing may occur on any screen or structures that serve as screens.

With this discovery in mind, the invention teaches that in order to employ copper wires or other copper elements that produce oxidation mats in and/or on screens employed as liquid receiving areas, the position of copper wires or elements is preferably planned and it may also be beneficial to: (i) form structural features into the screen; and/or (ii) add structural features to the screen, and/or (iii) position structural features in close proximity to the screen to avoid mechanically waterproofing large liquid-receiving areas of the screen. Elements that interact with the screen may also be employed.

Figure 9:
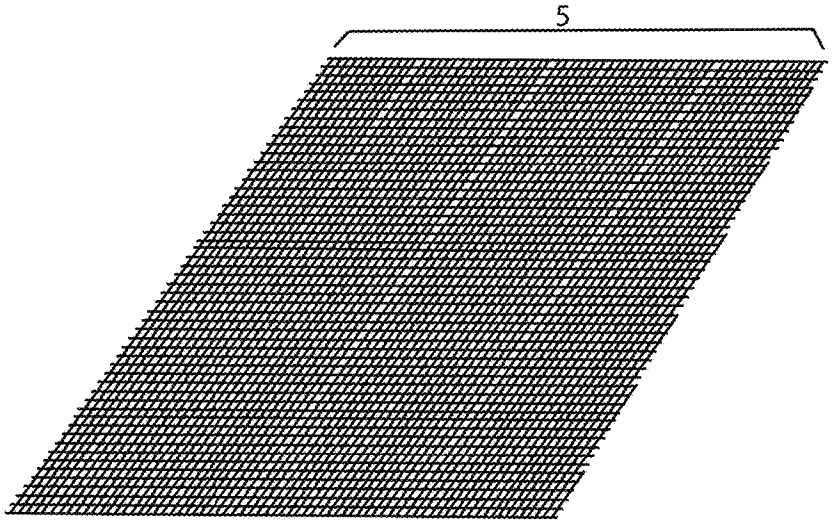
FIG. 9 is a perspective view of a screen in accordance with exemplary embodiments of the invention.
Figure 10:
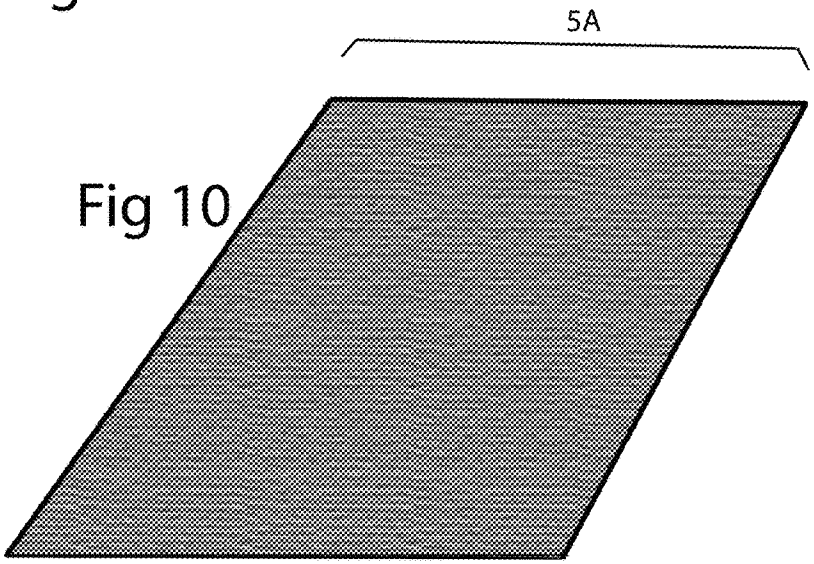
FIG. 10 is a perspective view of a screen in accordance with exemplary embodiments of the invention.
Figure 11:
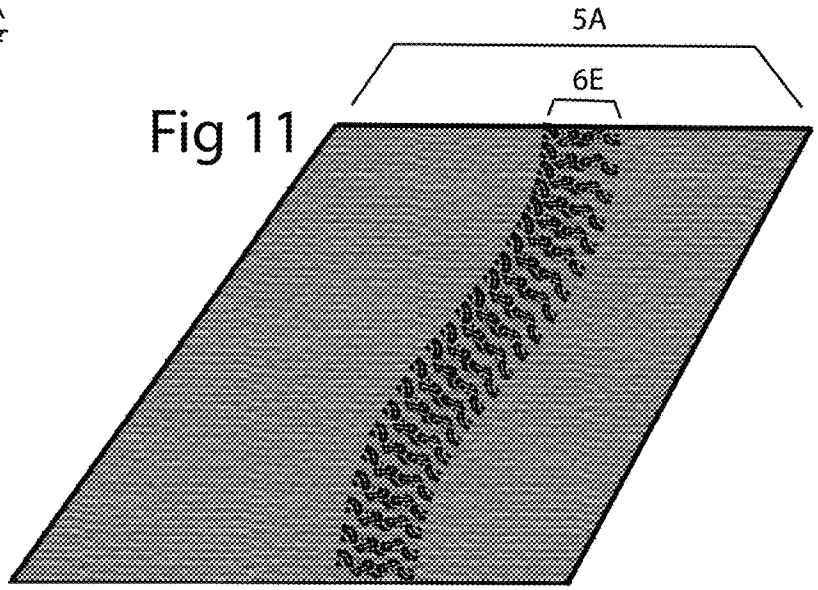
FIG. 11 is a perspective view of a screen having a pattern, in accordance with exemplary embodiments of the invention.
Figure 12:
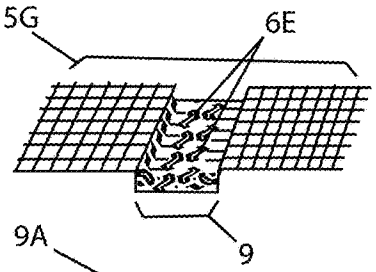
FIG. 12 is a perspective view of a downwardly extending channel having a pattern, in accordance with exemplary embodiments of the invention.
Figure 13:
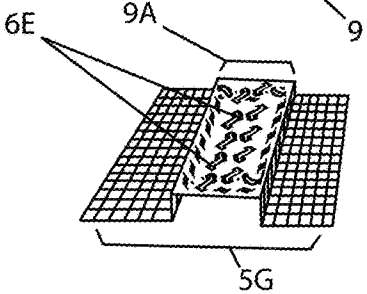
FIG. 13 is a perspective view of an upwardly extending channel having a pattern, in accordance with exemplary embodiments of the invention.

FIG. 9 shows a view of a screen 5 having individual wires that make up screen 5. FIG. 10 shows a screen 5A that is structurally similar to screen 5 of FIG. 9 but visually different in that it has a solid "cloth-textured appearance" that does not show visually discernable threads although they are present. FIG. 11 shows that a screen having a cloth-textured appearance, such as screen 5A, can make certain features present in the screen 5A such as a pattern 6E more discernible. This is due to the finer thread and/or closer spacing of the thread of a screen 5A having a cloth-textured appearance. FIG. 12 shows a section 5G of a screen (such as, for example, screen 5) having a downward extending channel or corrugation 9 having a partial tire tread pattern 6E present in or on or under the bottom plane of channel 9. Tire tread patterns, by design, have an ability to divert and redirect water. In some embodiments, such a pattern is embossed or pressed into the screen in any direction covering all or a portion of the screen or it is added as a separate element such as an adhesive applique or sprayed adhesive pattern (either coated with copper particles, or not coated with copper particles) or as solid or perforated metal or screen affixed or attached to screen 5G by adhesion, tension, or other methods. FIG. 13 illustrates a section 5G of screen (such as, for example, screen 5) having an upwardly raised channel or corrugation 9A. The top surface of raised channel or corrugation 9A is shown having a partial tire tread pattern 6E in or on or under the top surface of raised channel or corrugation 9A.

Figure 76:
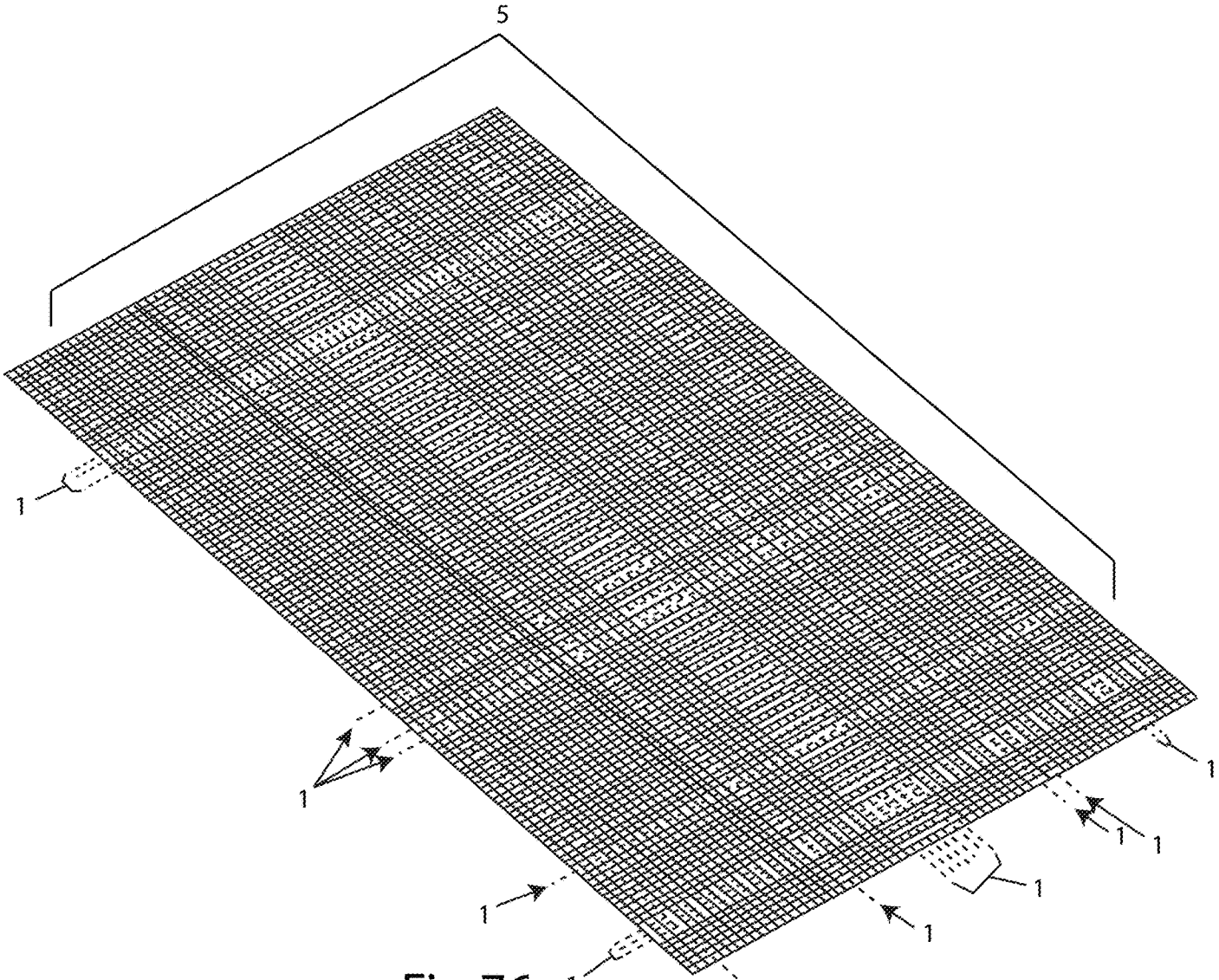
FIG. 76 is a perspective view of a screen in accordance with exemplary embodiments of the invention.
Figure 77:
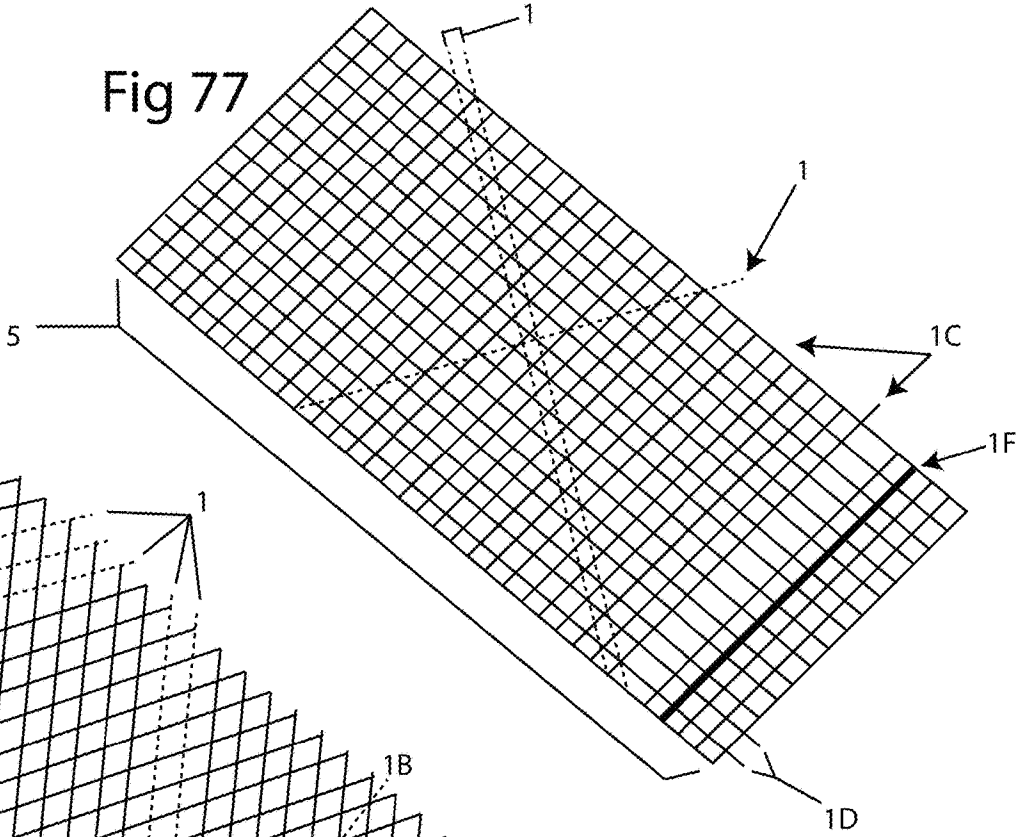
FIG. 77 is a perspective view of a screen in accordance with exemplary embodiments of the invention.

FIG. 76 is a view of a screen 5 showing larger or harder threads or a braid of threads 1 either woven, knitted or sewn (on or through screen 5) in a warp or weft direction at random locations into or onto the matrix of screen 5 illustrating that, in embodiments, any number of larger or harder threads or a braid of threads can be a part of, or attached to, a screen or any segment of a screen in a warp or weft direction. FIG. 77 illustrates that, in embodiments, larger or harder threads or a braid of threads 1 can additionally be woven, knitted, sewn, into, onto, or applied onto a screen 5 in a diagonal direction for a length of the screen. Also shown in FIG. 77 is a braid 1F (discussed below in relation to FIG. 80). FIG. 77 additionally shows an example of an embodiment in which screen 5 has warp (front edge to back edge) directioned threads 1C made of stainless steel infused with manganese or phosphorous or threads comprised of metal alloys that provide a stiff thread with a greater hardness than that of weft (longitudinal directioned) threads 1D. This makes the screen less susceptible to concaving or convexing in embodiments where the screen spans large unsupported-from-the-underside water receiving areas of a gutter guard, or in embodiments where the screen serves unilaterally as a gutter guard or as the main portion of a gutter guard. Concurrently, the softer weft threads 1D allow the screen to be rolled into large screen rolls without crimping weft threads 1D, with the screen roll then being able to be unrolled by means of a decoiler, for example, during the manufacturing process. Other advantages of a "hard warp, soft weft" thread screen may exist and be employed in this invention or as a component of other inventions. Throughout this disclosure, a "harder warp, softer weft" threaded screen may be substituted for a corrugated screen.

Although not illustrated, threads may additionally be woven, knitted, sewn into or onto or applied onto any screen or segment or side of a screen in any pattern or direction.

Figure 78:
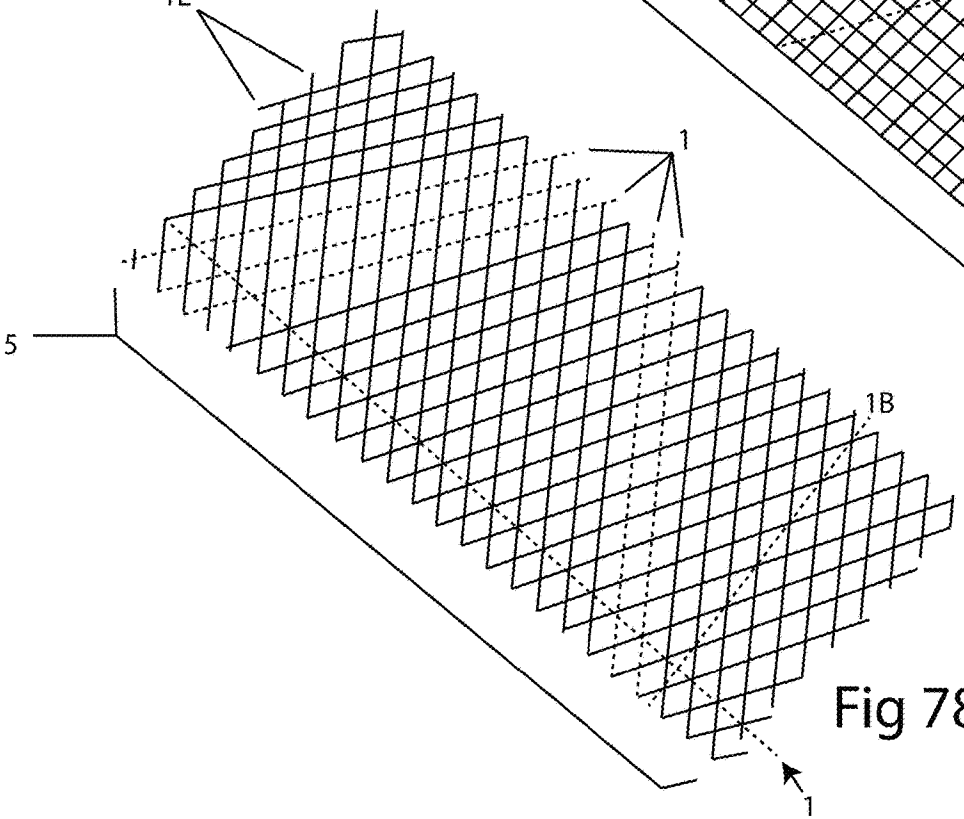
FIG. 78 is a perspective view of a screen in accordance with exemplary embodiments of the invention.

FIG. 78 is another embodiment showing a screen 5 having threads 1E woven in a diagonal direction. Also shown are larger or harder threads or a braid of threads 1 woven in a diagonal direction, a larger or harder thread or a braid of threads 1 traversing in a longitudinal/weft direction, and a larger or harder thread or a braid of threads 1B traversing in a transverse or warp direction. Other embodiments use a different number of larger or harder threads or a braid of threads 1 shown in FIG. 78.

Figure 63:
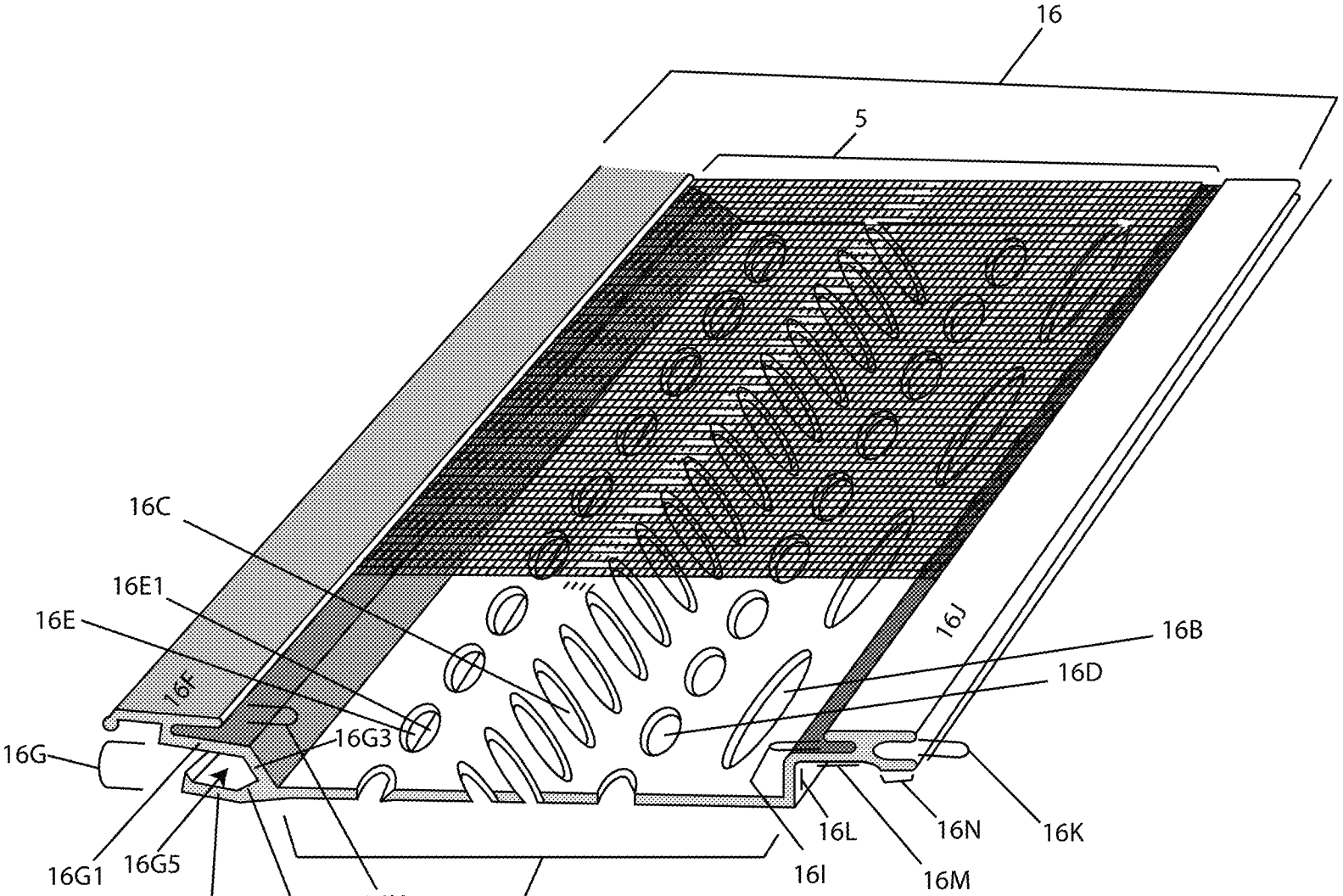
FIG. 63 is a perspective view of exemplary embodiments of the invention.

FIG. 63 shows a gutter guard 16 having a perforated lower plane 16A overlain by a screen 5 which serve in combination as a water receiving area of gutter guard 16. The term "gutter guard" is understood to mean a structure for preventing or reducing the amount of debris that enters a gutter such as, for example, a rain gutter on a building. Perforations 16B, 16C, 16D, 16E present in perforated lower plane 16A are shown to demonstrate that any type, size, or shape of perforation may be employed by gutter guard 16. A body of gutter guard 16 has a T-shaped first member 16F that overlies and adjoins a modified U-shaped lower member 16G having an upper plane 16G1, a lower plane 16G2 and two rear sidewalls 16G3, 16G4. U-shaped lower member 16G utilizes a channel 16G5 that is able to receives a downward angling plane present at the rear of the top lip of some rain gutters such as, for example, K-style gutters. U-shaped lower member 16G adjoins perforated lower plane 16A, which has an upward extending plane 16L that adjoins a lateral plane 16M. Lateral plane 16M adjoins a T-shaped member 16J which has an extending lateral lower plane 16N. Element 16K is a receiving channel existing above lateral lower plane 16N. Receiving channel 16K is configured to receive various elements to enable gutter guard 16 to be secured or adjoined or made adjacent to a fascia board of a building, or that may enable gutter guard 16 to be secured to or rest upon the sub-roof or other structure of a building.

Figures 64, 65:
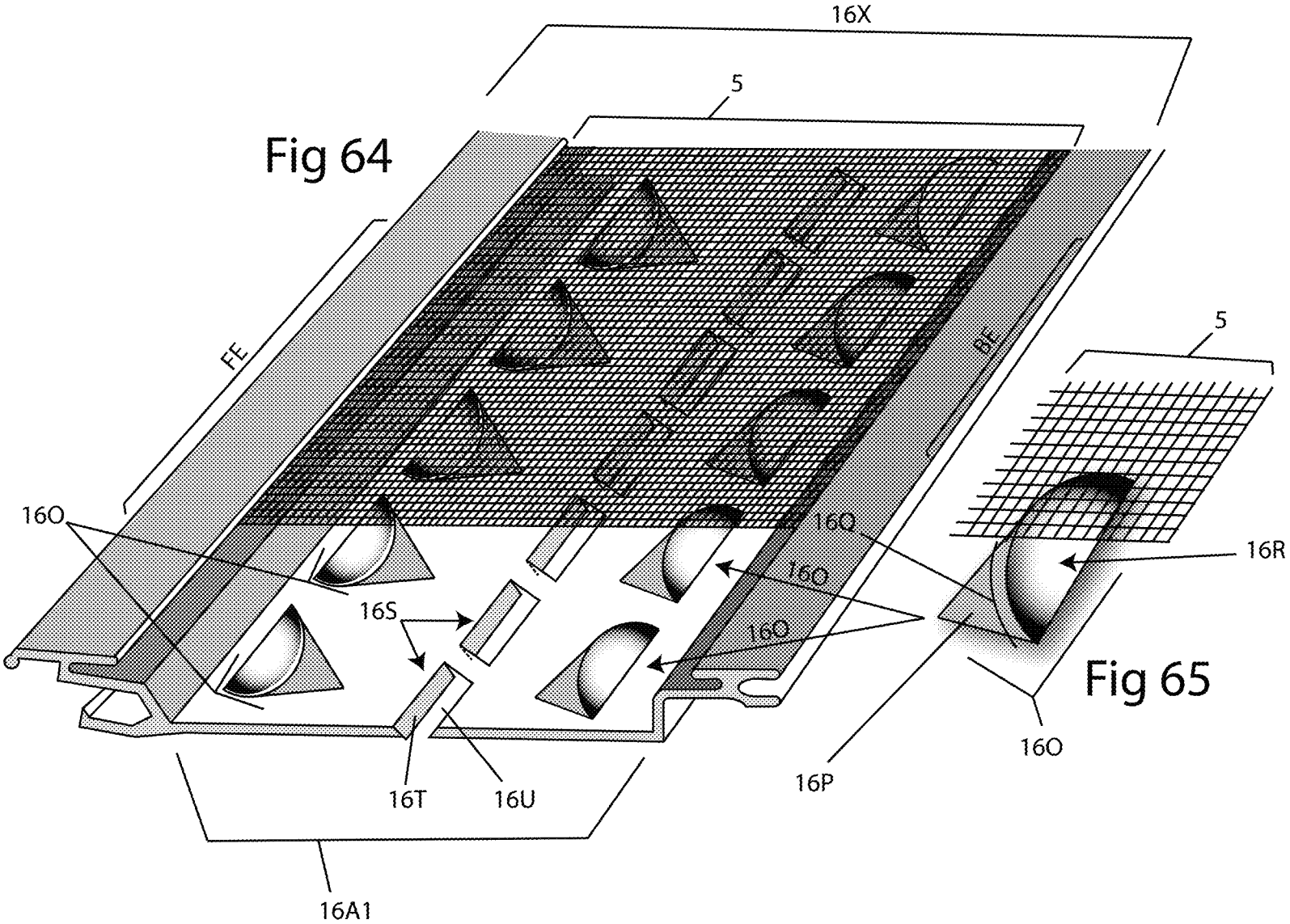
FIG. 64 is a perspective view of exemplary embodiments of the invention.
FIG. 65 is a detail view of the embodiment shown in FIG. 64.

FIG. 64 shows a gutter guard 16X having a louvered lower plane 16A1 overlain by a screen 5 which serve in combination as a water receiving area of gutter guard 16X. FIG. 65 shows a larger scale representation of hooded louvers/perforations/extensions 160 present in louvered lower plane 16A1 of this embodiment. Louvers 160 are shown having a raised hood 16P framing an open air space 16R. Raised hood 16P has an edge 16Q that is shown, in this embodiment, touching or in close proximity to screen 5. In some embodiments screen 5 has larger or harder threads or a braid of threads present within its matrix. In other embodiments screen 5 does not have larger or harder threads or a braid of threads present within its matrix. FIG. 64 shows louvers 160 facing toward a rear edge BE of gutter guard 16X as well as facing toward a front edge FE of gutter guard 16X. Also shown are elongated openings 16S having planes 16T that extend downward leaving open air spaces 16U for water to flow through. In this embodiment, downward extending planes 16T of openings 16S extend from the long edge of elongated openings 16S closest to front edge FE of gutter guard 16X. In this embodiment, the body profile of gutter guard 16X is the same as the body profile of gutter guard 16 shown in FIG. 63. It is understood that the shapes, dimensions, placement and/or direction of louvers, perforations and extensions are not limited to the embodiments shown. The embodiments shown in the figures are only representative.

Figures 14, 14A:
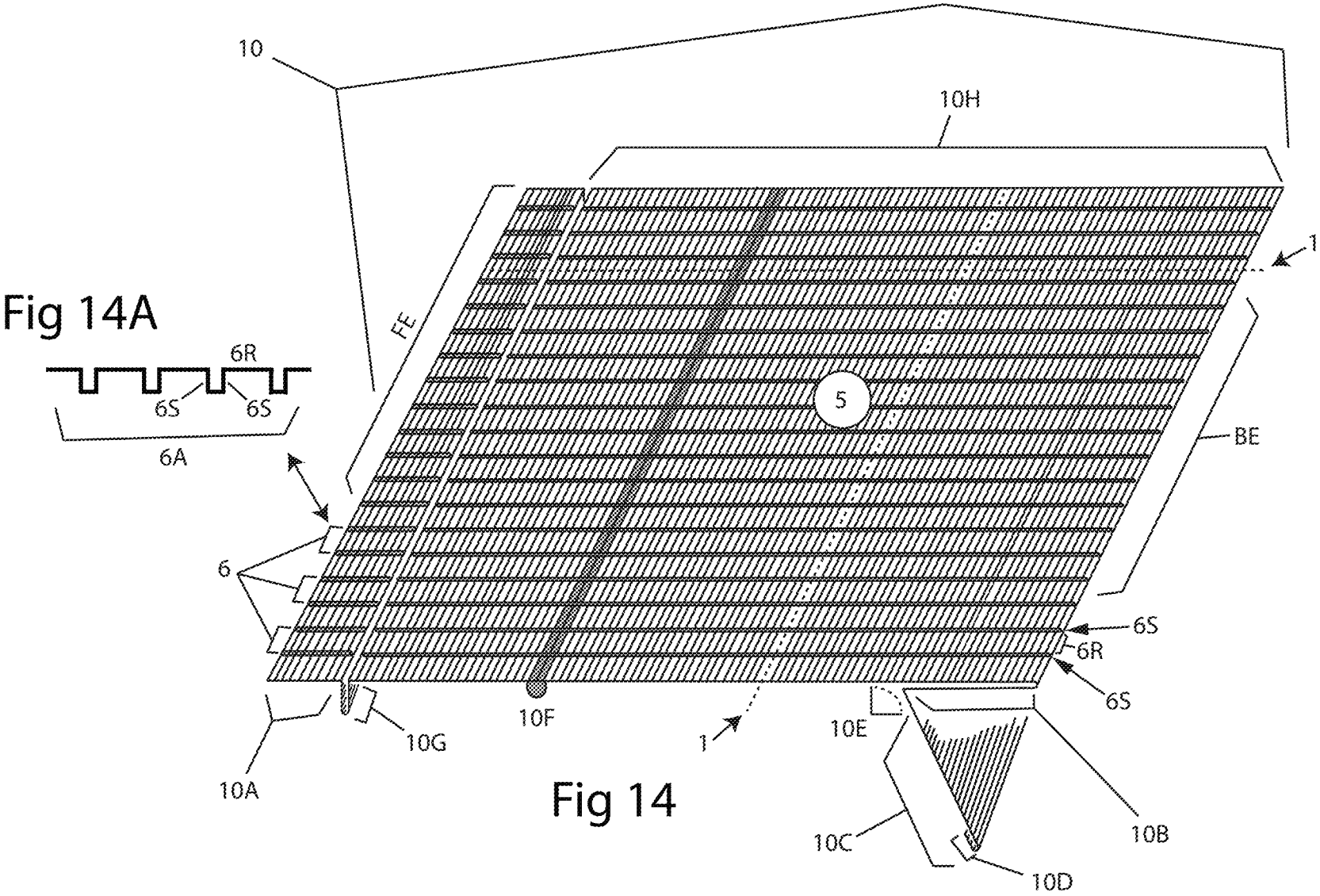
FIG. 14 is a perspective view of a gutter guard having a corrugated screen and a wire on the underside of the screen in accordance with exemplary embodiments of the invention.
FIG. 14A is a cross-sectional view of a corrugation present in the screen of FIG. 14.
Figures 15, 16, 17, 18, 19, 20, 21, 22, 23, 24, 25, 26, 27, 28, 29, 30, 31, 32, 33:
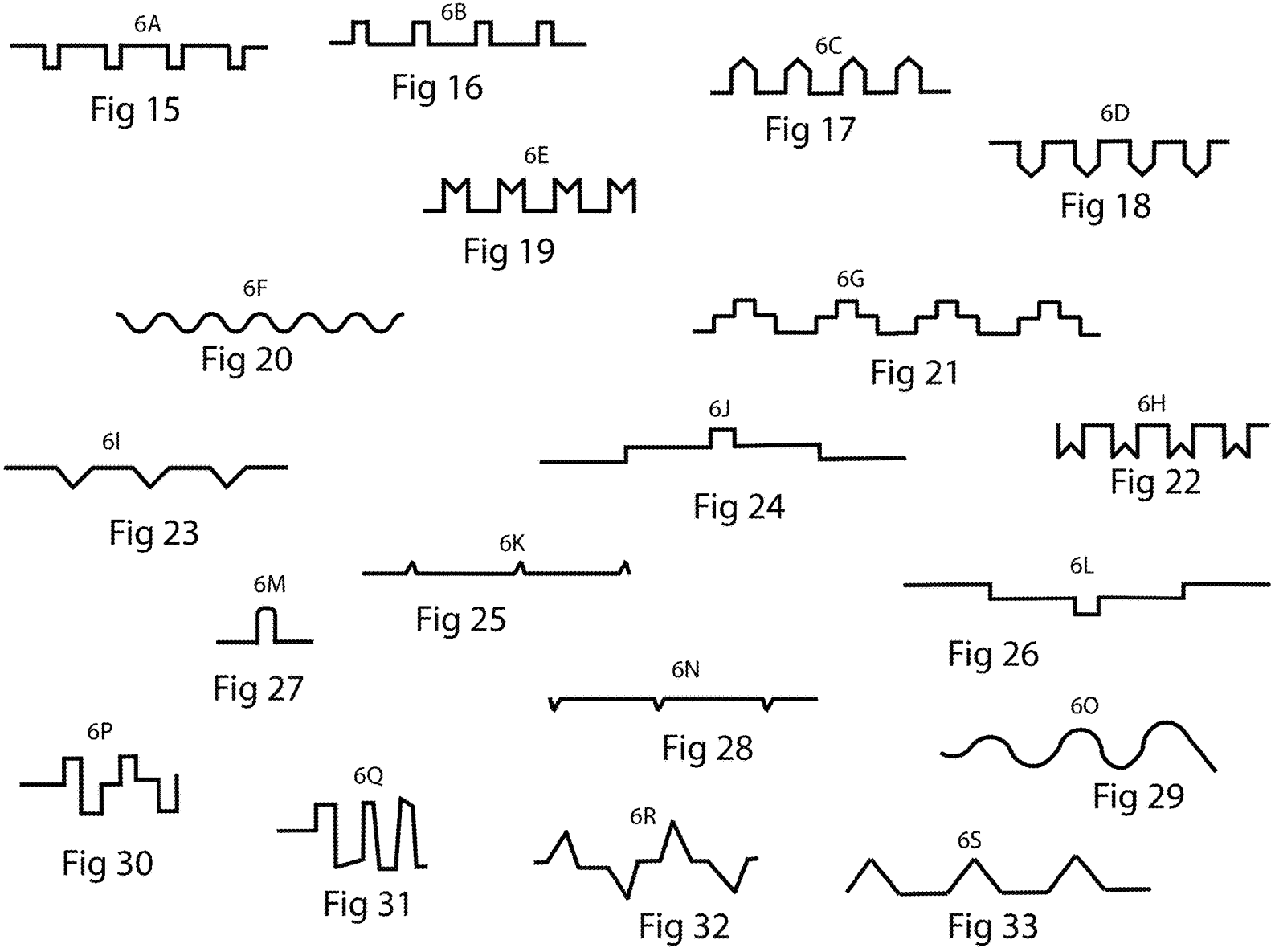
FIG. 15 is a cross-sectional view of a corrugation pattern of a screen in accordance with exemplary embodiments of the invention.
FIG. 16 is a cross-sectional view of a corrugation pattern of a screen in accordance with exemplary embodiments of the invention.
FIG. 17 is a cross-sectional view of a corrugation pattern of a screen in accordance with exemplary embodiments of the invention.
FIG. 18 is a cross-sectional view of a corrugation pattern of a screen in accordance with exemplary embodiments of the invention.
FIG. 19 is a cross-sectional view of a corrugation pattern of a screen in accordance with exemplary embodiments of the invention.
FIG. 20 is a cross-sectional view of a corrugation pattern of a screen in accordance with exemplary embodiments of the invention.
FIG. 21 is a cross-sectional view of a corrugation pattern of a screen in accordance with exemplary embodiments of the invention.
FIG. 22 is a cross-sectional view of a corrugation pattern of a screen in accordance with exemplary embodiments of the invention.
FIG. 23 is a cross-sectional view of a corrugation pattern of a screen in accordance with exemplary embodiments of the invention.
FIG. 24 is a cross-sectional view of a corrugation pattern of a screen in accordance with exemplary embodiments of the invention.
FIG. 25 is a cross-sectional view of a corrugation pattern of a screen in accordance with exemplary embodiments of the invention.
FIG. 26 is a cross-sectional view of a corrugation pattern of a screen in accordance with exemplary embodiments of the invention.
FIG. 27 is a cross-sectional view of a corrugation pattern of a screen in accordance with exemplary embodiments of the invention.
FIG. 28 is a cross-sectional view of a corrugation pattern of a screen in accordance with exemplary embodiments of the invention.
FIG. 29 is a cross-sectional view of a corrugation pattern of a screen in accordance with exemplary embodiments of the invention.
FIG. 30 is a cross-sectional view of a corrugation pattern of a screen in accordance with exemplary embodiments of the invention.
FIG. 31 is a cross-sectional view of a corrugation pattern of a screen in accordance with exemplary embodiments of the invention.
FIG. 32 is a cross-sectional view of a corrugation pattern of a screen in accordance with exemplary embodiments of the invention.
FIG. 33 is a cross-sectional view of a corrugation pattern of a screen in accordance with exemplary embodiments of the invention.

FIGS. 14 and 14A illustrate a gutter guard 10 having a screen 5 being shaped to be placed on and/or in a rain gutter. Screen 5 has a first portion 10A that rests on or under the front lip of a rain gutter, a second portion 10G which is a downwardly extending inseam adjacent to a third portion 10H which is the main body of gutter guard 10. Main body 10H of gutter guard 10 has a rear portion 10B that folds under main body 10H and then extends downwardly into a rear leg 10C. Rear leg 10C is angled away (indicated by 10E) from main body 10H and has an upward fold 10D at its terminal edge. Gutter guard 10 is shown having one single copper thread 1 present within its matrix in a left edge to right edge direction and one single copper thread 1 present within its matrix in a front to rear direction. FIG. 14 also shows gutter guard 10 having a bead of caulk or adhesive or other element 10F adjacent to an underside of main body 10H which serves to intercept water flowing on and through screen 5 and redirect it downward into an underlying rain gutter. A bead of caulk or adhesive or other element can extend through screen 5 in some embodiments. In embodiments, a bead (or other shaped) application of caulk or other material that hardens over a period of time is applied to add strength to screen 5. In embodiments, a bead (or other shaped) application of caulk or other material that hardens over a period of time is applied to add strength to screen 5 that has few or no features that add structural stability. In embodiments, caulk or adhesive or element 10F is made of or contains copper and may be present on any portion of the screen's top or bottom surfaces and may extend in any direction. Caulk or adhesive or other element 10F may be sprinkled or otherwise coated or infused with copper elements. In embodiments, a protrusion can extend from screen 5, or can extend toward screen 5 from an element that is not part of screen 5. In embodiments, a protrusion can extend toward screen 5 from another screen.

Screen 5 of gutter guard 10 may or may not be corrugated or partially corrugated with corrugations of any pattern or construction traversing in any direction. FIG. 14 shows screen 5 having front edge FE to rear edge BE corrugations 6, with each corrugation 6 having a top surface 6R and downward extending sidewalls 6S. This corrugated pattern 6A is one of the various corrugated patterns whose profiles 6A-6S are illustrated, respectively, in FIGS. 15-33. This collection of corrugation profiles is intended to serve as a representative sampling only, and demonstrates that any type of corrugated pattern can be employed in the body of a screen. Further, in embodiments, corrugations extend in any direction, in linear or non-linear fashion, and completely across screen 5 or only partially across screen 5.

Figure 35:
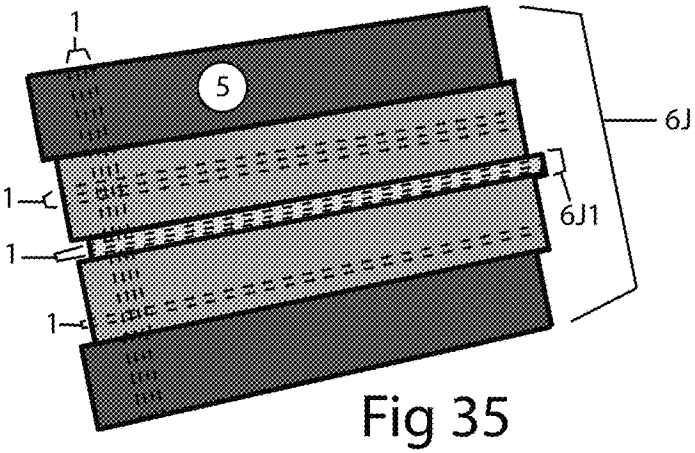
FIG. 35 is a perspective view of the corrugated profile shown in FIG. 24 showing the corrugation in a transverse direction.
Figure 37:
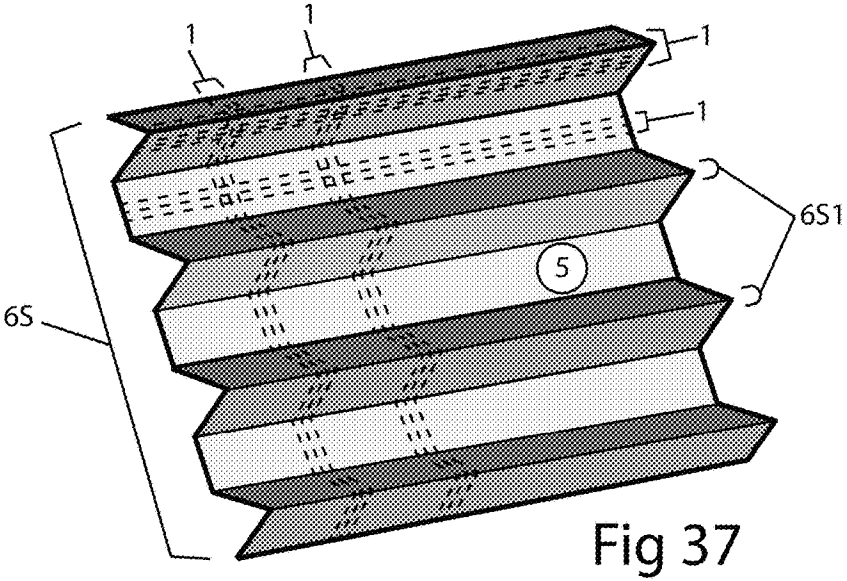
FIG. 37 is a perspective view of the corrugated profile shown in FIG. 33 showing the corrugation in a transverse direction.
Figure 34:
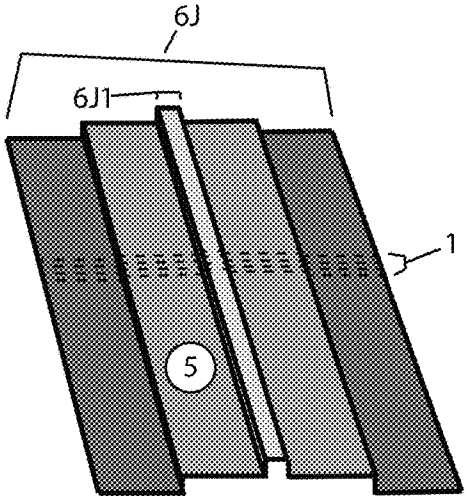
FIG. 34 is a perspective view of the corrugated profile shown in FIG. 24 showing the corrugation in a longitudinal direction.
Figure 36:
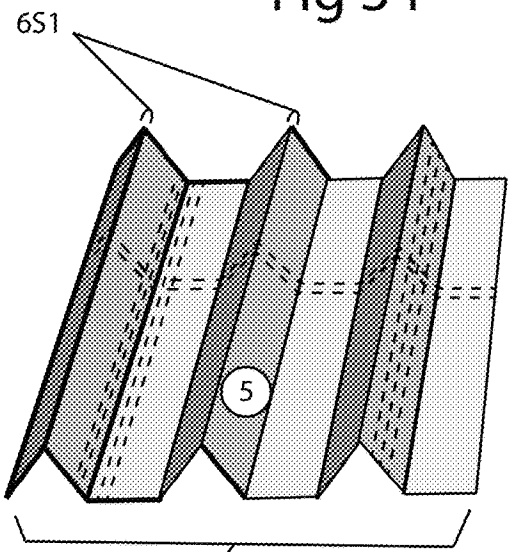
FIG. 36 is a perspective view of the corrugated profile shown in FIG. 33 showing the corrugation in a longitudinal direction.

Although appearing as solid planes to better illustrate larger or harder threads or a braid of threads 1, the planes shown in FIGS. 34, 35, 36 and 37 are representative of screen. FIGS. 34 and 36 show, respectively, corrugated patterns 6J and 6S as they would appear if embodied in a screen 5 and placed in a manner that the uppermost portion of the corrugations 6J1 and 6S1 were in line with water flow coming off the roof of a building or, alternately, perpendicular to water flow coming off a roof of a building as shown in FIGS. 35, 37. Each corrugated pattern is shown having larger or harder threads or a braid of threads 1 present in their respective screens 5. These patterns may exist as embossments pressed upwardly or downwardly into the body of screen 5 or as independent elements adjacent to or attached to or affixed to screen 5 by adhesion, weaving, sintering or by other methods and may be present in areas that may or may not be made of or contain larger or harder threads or a braid of threads. These corrugated patterns themselves can be made of or contain larger or harder threads or a braid of threads or not made of or contain larger or harder threads or a braid of threads. Larger or harder threads or a braid of threads 1 present in the patterns are shown traversing in warp and weft directions but can additionally or alternatively travel in any direction. Further, in embodiments, corrugations, patterns, and threads extend in any direction, in linear or non-linear fashion, and completely across screen 5 or only partially across screen 5

FIG. 38 shows a screen 5E having upwardly or downwardly extending wave-shaped corrugations 21 pressed into the body of screen 5E that extend from the rear edge BE of screen 5E to the front edge FE of screen 5E. Although not illustrated, corrugations 21 can be of any length and travel in any direction or directions. FIG. 39 shows a single wave-shaped corrugation 21. FIG. 40 shows a wave shaped corrugation 21A having concave or convex shapes 21C present within or attached to corrugation 21A. FIG. 41 shows a wave shaped corrugation 21B having concave or convex shapes 21C with additional concave or convex shapes 21D present within or attached to the larger concave or convex shape 21C. FIG. 42 shows screen 5E having upwardly or downwardly wave-shaped corrugations 21BS and 21BT that have intrinsic or attached concave or convex shapes 21E. Corrugations 21BS, 21BT can alternatively or additionally have concave or convex shapes 21C or 21D. Corrugations 21BS, 21BT are shown traversing from the left (LE) to right (RE) edges of the screen. Although not illustrated, corrugations 21, 21A, 21B, 21BS, 21BT can also be partial and/or in a diagonal or other or multiple directions. These shapes and corrugations can be made of any material and can be present of not present in areas of the screen that contain larger or harder threads or a braid of threads.

FIGS. 43-49 are a collection of representative shape samples illustrating that any shape can be embossed upwardly or downwardly into, woven or embroidered into or onto, or adjacent to, or attached to, or affixed to, painted onto, or otherwise implemented into or onto a filtering screen or other areas of a gutter guard. FIG. 48 shows a raised emblem having a circular shape and the phrase "Team Mascot". It is noted that FIG. 48 represents any team, or association, logo, name, or symbol. As with all other shapes, these shapes can be multi-leveled to create surfaces that disrupt or reorganize the flow of water over them to create a water flow that is more likely to flow through the screen. Such shapes can be employed as a single element or as a plurality of elements present randomly or present in a pattern or patterns traversing in any direction. These shapes can be made of or contain larger or harder threads or a braid of threads or not be made of or contain larger or harder threads or a braid of threads. The shapes can be separate elements that are made of or contain larger or harder threads or a braid of threads or not be made of or contain larger or harder threads or a braid of threads. Any shape may be multi-planed/multi-dimensioned.

Figures 50, 51:
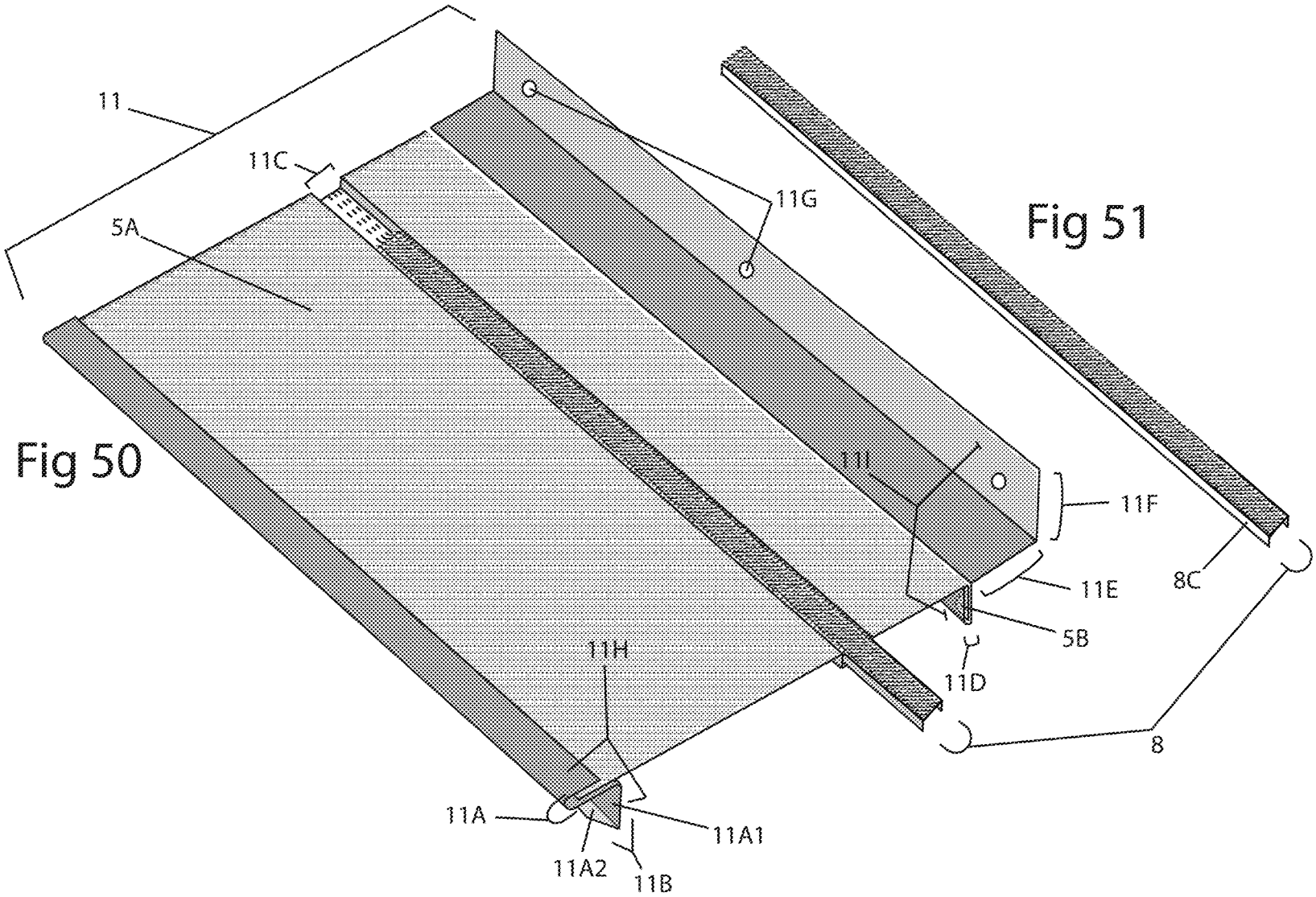
FIG. 50 is a perspective view of exemplary embodiments of the invention.
FIG. 51 is a perspective view of an insert in accordance with exemplary embodiments of the invention.

FIG. 50 shows a gutter guard 11 having a front assembly 11H with a receiving channel 11A adjoining a distending plane 11A1 and a rising plane 11A2 that form a securing member 11B able to secure gutter guard 11 to a front top lip of a rain gutter. Gutter guard 11 is also shown having a rear assembly 11I with a receiving channel 11D, whose rear wall extends upward into a horizontal plane 11E. Horizontal plane 11E extends upward at its rear edge into an upwardly extending plane 11F. Upwardly extending plane 11F is configured to be adjacent to a fascia board of a building when gutter guard 11 is installed into or atop a rain gutter. Screws can be passed through perforations 11G present in upwardly extending plane 11F into a fascia board of a building to fasten gutter guard 11 to the building. Receiving channels 11A and 11D receive the front and rear terminal edges of screen 5A. Present within the body of screen 5A is a recessed channel 11C that receives a copper or other material or other shaped or dimensioned element 8. Element 8 can be a solid material or screen or expanded metal, or a solid or porous material of any shape. FIG. 51 shows element 8 separate from screen 5A. The sidewalls 8C of element 8 can be coated with adhesive or have double sided adhesive tape attached to help secure one gutter guard 11 to an adjoining gutter guard 11 by being partially located in a recessed channel 11C of the adjoining gutter guard 11, keeping the screened area 5A of both gutter guards 11 in the same plane. Employing a stiff screen or other stiff material as an insertable element 8 can strengthen the ability of gutter guard 11 to support snow loads.

Figures 52, 53:
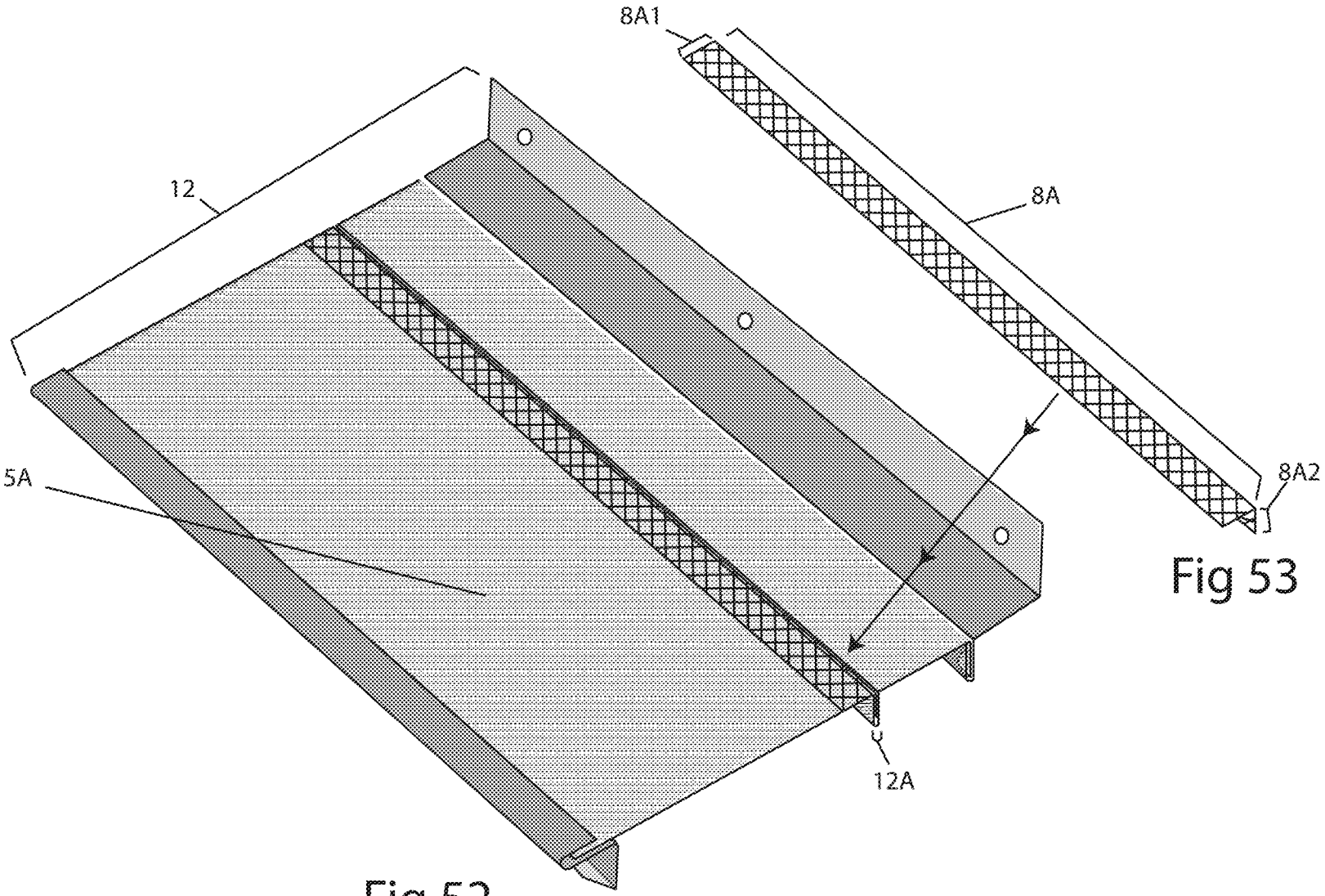
FIG. 52 is a perspective view of exemplary embodiments of the invention.
FIG. 53 is a perspective view of an insert in accordance with exemplary embodiments of the invention.

FIG. 52 shows a gutter guard 12 having a downwardly extending narrow channel 12A into which is inserted an expanded metal or other expanded material screen 8A. FIG. 53 shows expanded metal or other expanded material screen 8A being "L" shaped having a top plane adjoining at its edge a downwardly extending plane 8A2. Expanded metal screen 8A may or may not be further secured into channel 12A with adhesive or staples that pass through downward extending channel 12A or by crimping or by other means and can overlap into the narrow channel 12A of an adjoining gutter guard 12. Employing a stiff screen or other stiff material as an insertable element 8A can strengthen the ability of gutter guard 12 to support snow loads.

Figures 54, 55, 56, 56A:
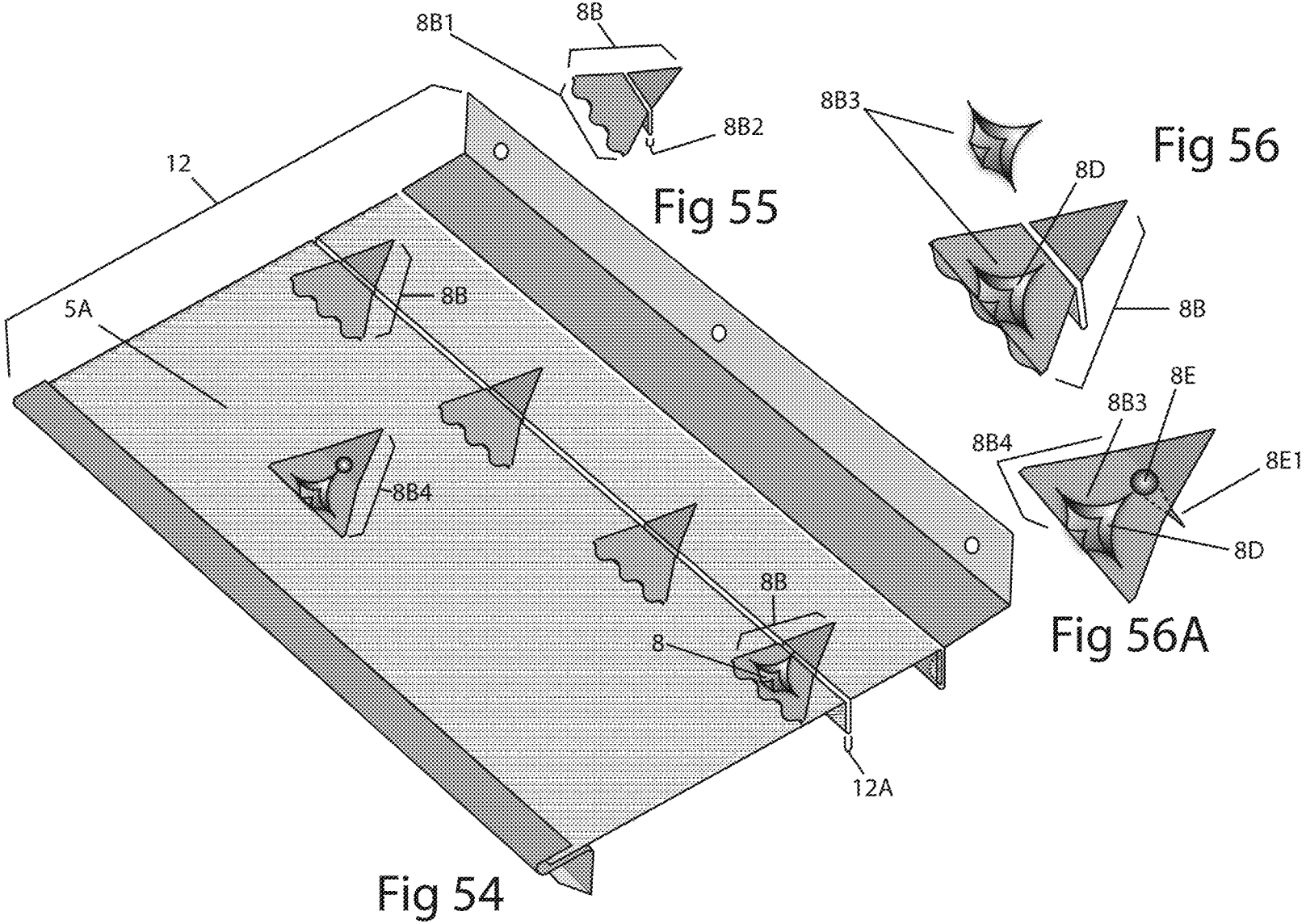
FIG. 54 is a perspective view of exemplary embodiments of the invention.
FIG. 55 is a perspective view of an insert in accordance with exemplary embodiments of the invention.
FIG. 56 is a perspective view of an insert in accordance with exemplary embodiments of the invention.
FIG. 56A is a perspective view of an insert in accordance with exemplary embodiments of the invention.

FIGS. 54 and 55 show gutter guard 12 of FIG. 52 having shaped copper or non-copper elements 8B with, referring specifically now to FIG. 55, downward extending planes or channels 8B2 that are inserted into downward extending channel 12A of gutter guard 12. The downward extending channels 12A may or may not employ an adhesive tape or an adhesive or staples or crimping to further secure shaped elements 8B within downward extending channels 12A. FIG. 56 illustrates that shaped element 8B may have an additional shaped element 8B3 present on its top surface. Additional shaped element 8B3 can employ an open air space 8D transforming the insert into a louvered element that helps capture forward flowing water and redirect it downward through screen 5A offering more surface area for water contact and redirection (and in the case where additional shaped element 8D3, shaped element 8B, or screen 5A includes copper, copper disbursement). In addition to the triangular shape 8B with scalloped front edge 8B1 shown in FIGS. 54-56, any shape may be employed as a shaped element having a downward extending member that would insert into the receiving channel of screen 5A. FIG. 56A shows a shaped element 8B4 employing a push pin 8E for securing 8B4 onto a screen (for example screen 5A). An end of push pin 8E can be bent upward after being pushed downward through screen 5A, fastening element 8B4 in place. In embodiments, any of the push pins can have an element that attaches to the bottom, similar to the back side of a lapel pin. That element can be attached in its entirety with adhesive and can start on the metal at the back and not be attached solely on the screen part.

Figure 62:
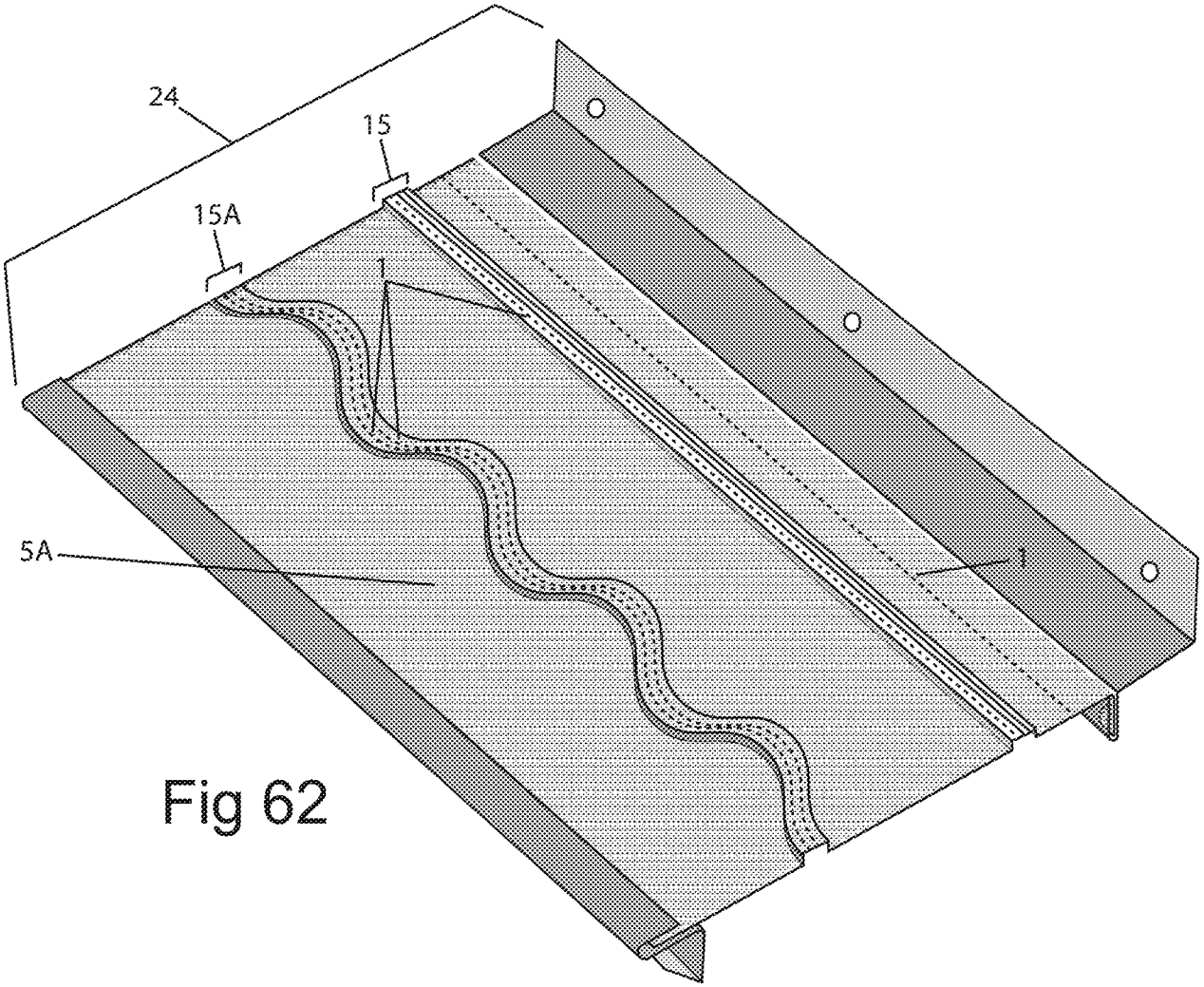
FIG. 62 is a perspective view of exemplary embodiments of the invention.

FIG. 62 shows a gutter guard 24 having a screen 5A as its water-receiving area. Present within screen 5A are a linear upward raised corrugation 15 and a shaped upward raised corrugation 15A, both of which traverse from the left to right edges of gutter guard 24. Larger or harder threads or a braid of threads 1 may or may not be present on the surfaces or side walls of the upraised corrugations 15, 15A. A larger or harder thread or a braid of threads is also shown present in a first planar portion of screen 5A preceding corrugation 15. Although illustrated traversing fully from the left to the right edge of screen 5A, one or both of corrugations 15, 15A can traverse in any direction over any portion of screen 5A.

Figures 57, 58:
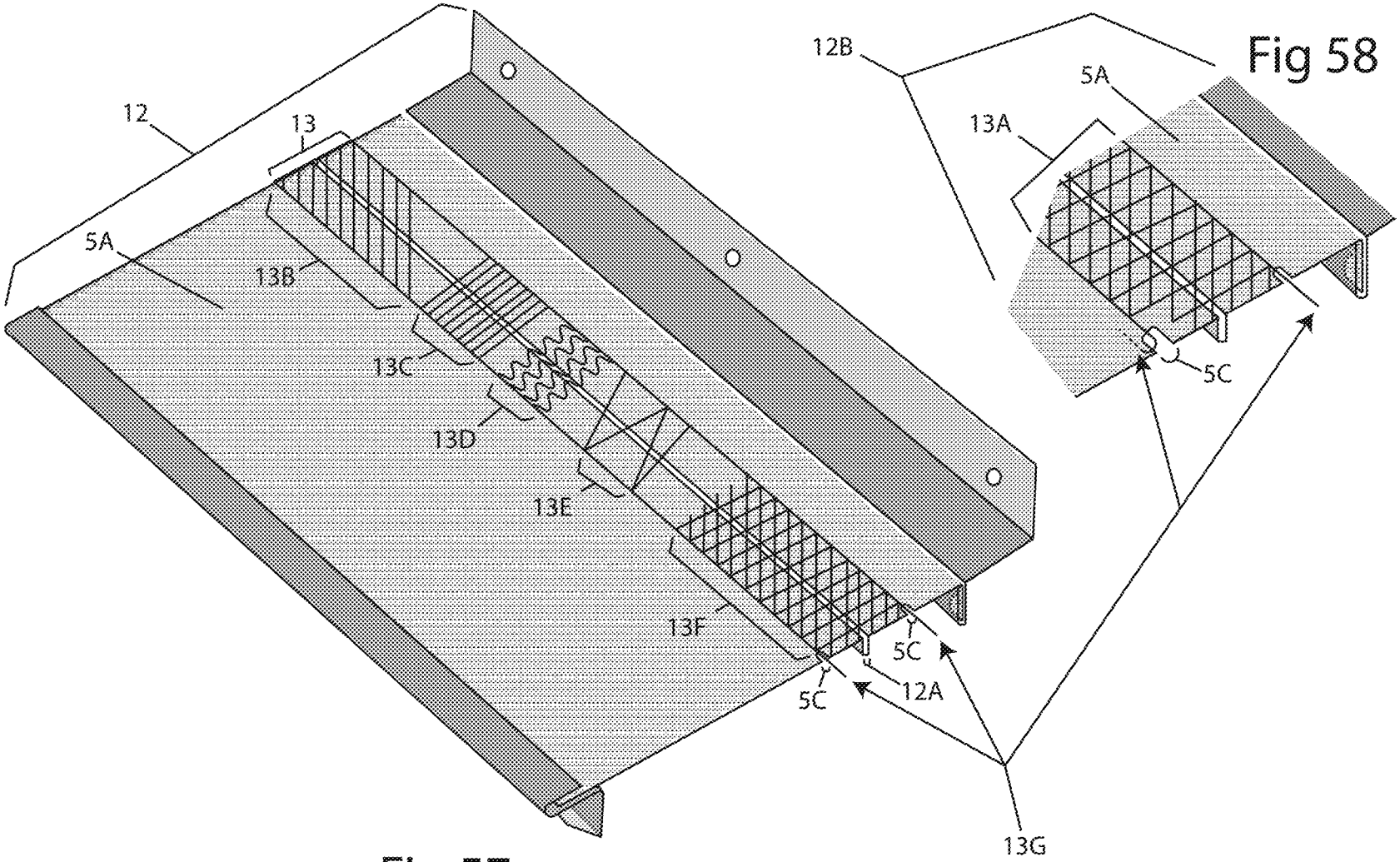
FIG. 57 is a perspective view of exemplary embodiments of the invention.
FIG. 58 is a detail view of an edge the embodiment shown in FIG. 57.

FIG. 57 shows a gutter guard 12 having an expanded metal or screen overlay 13 overlaying downward extending channel 12A. FIG. 58 is an enlarged view of a section 12B of gutter guard 12 that shows screen 5A having notched areas 5C that receive extending ends 13G of a screen overlay 13A. Extending ends 13G can be bent around as a way of securing screen overlay 13A to underlying screen 5A. FIG. 57 shows that screen overlay 13 can include any pattern of threads or wires including but not limited to patterns 13B, 13C, 13D, 13E, 13F shown. Screen overlay 13 may be positioned in any direction and on any portion of gutter guard 12.

Figures 59, 60:
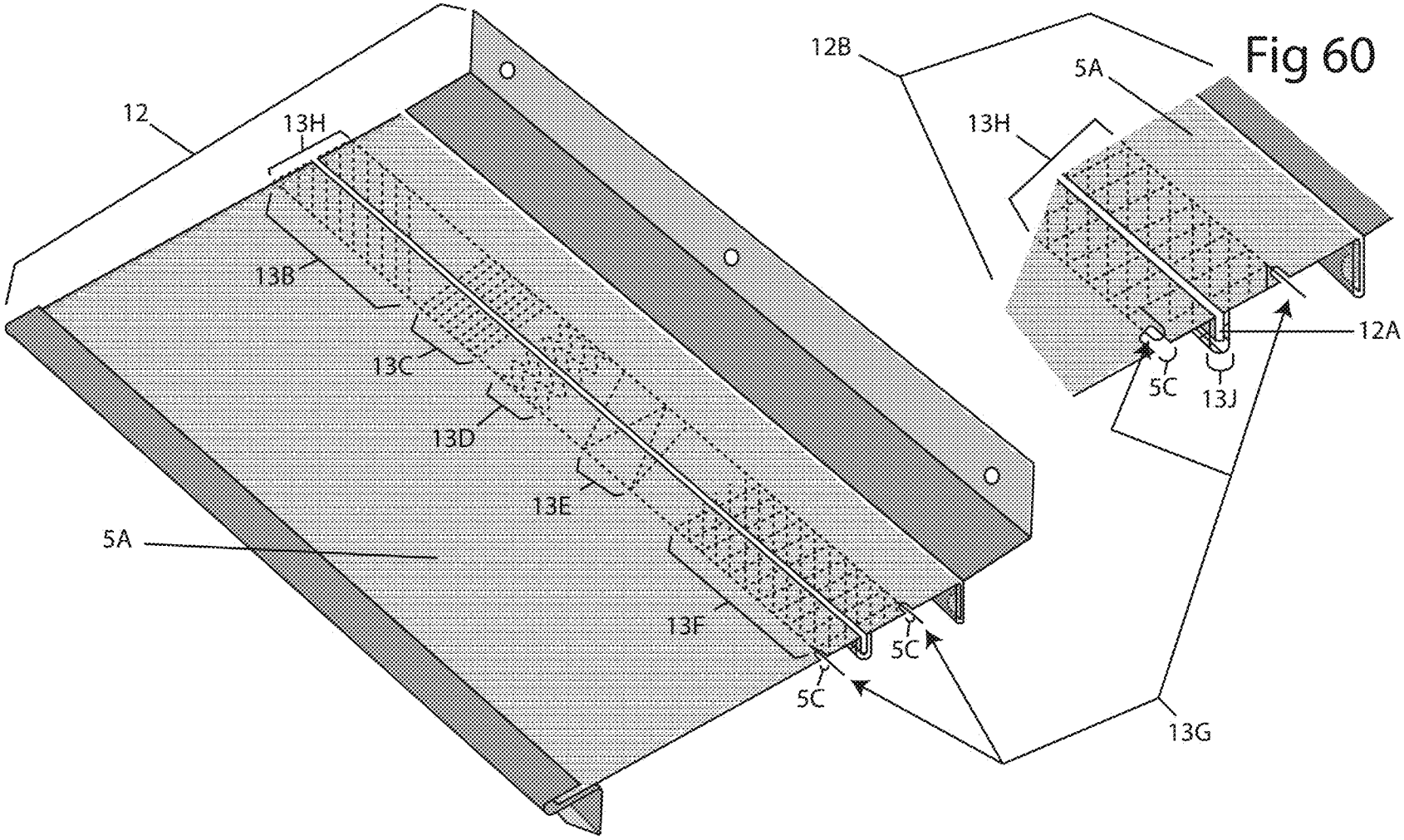
FIG. 59 is a perspective view of exemplary embodiments of the invention.
FIG. 60 is a detail view of an edge the embodiment shown in FIG. 59.

FIG. 59 shows gutter guard 12 having a screen underlay 13H that underlays water receiving screen 5A of gutter guard 12. FIG. 60 is an enlarged view of a portion 12B of gutter guard 12 showing screen underlay 13H having a downward extending channel 13J surrounding downward extending channel 12A of water receiving screen 5A. Adhesive can be used to attach screen underlay 13H to the underside of screen 5A or downward extending channel 13J can be crimped onto downward extending channel 12A or screen underlay 13H can be secured by other methods. Although a screen is shown as the underlying element 13H other elements such as, but not limited to, perforated or solid metal, tape, or caulks, may alternatively or additionally be used.

Figure 61:
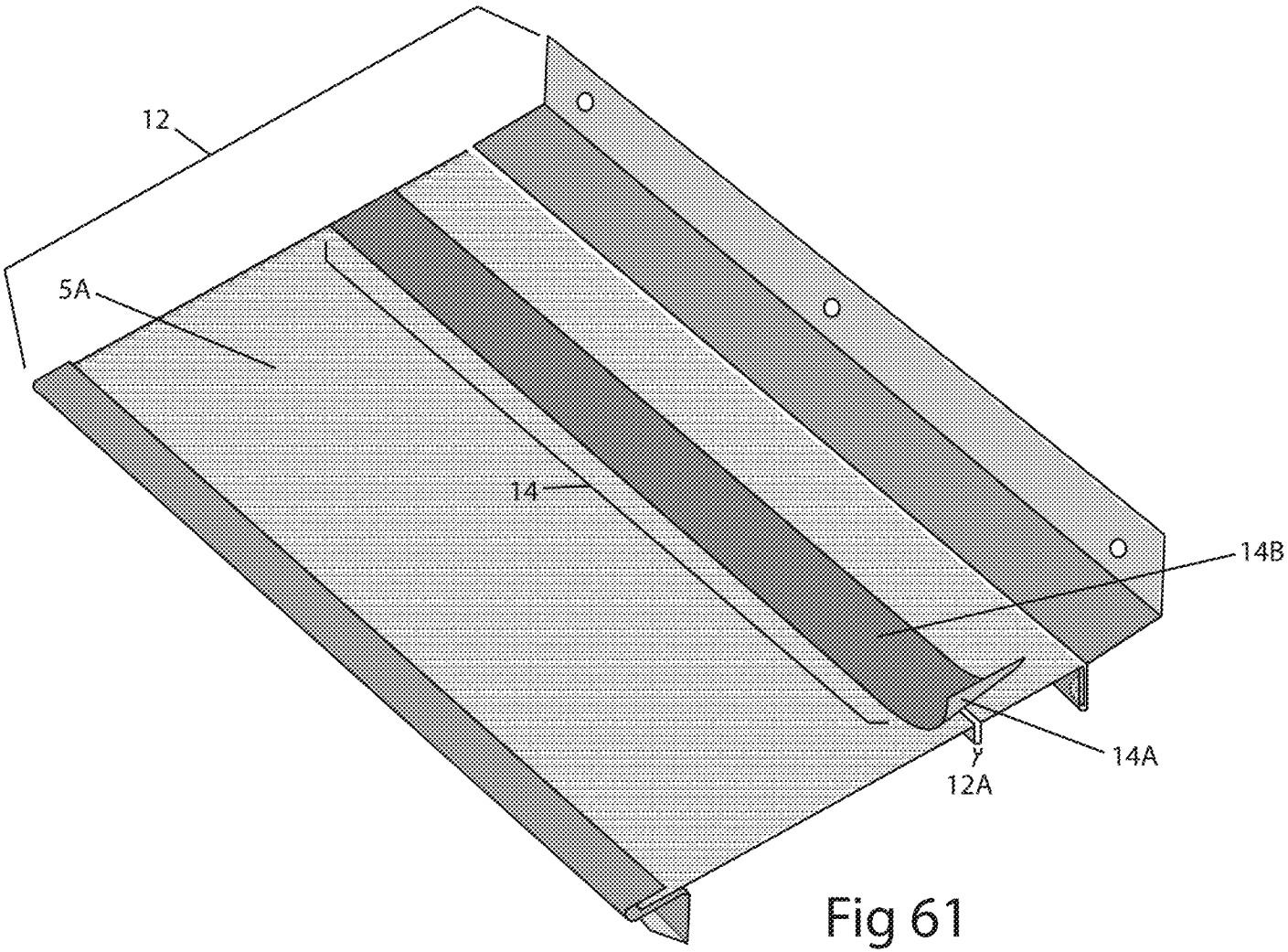
FIG. 61 is a perspective view of exemplary embodiments of the invention.

FIG. 61 shows a gutter guard 12 having a (copper or other material) ribbon or tape 14 with an adhering bottom surface 14A overlying a portion of water receiving screen 5A. Tape 14 is shown having a smooth solid top surface 14B but top surface 14B can be porous and/or rough and/or have copper material or non-copper granules present that can serve to inhibit mechanical waterproofing and/or to release ions. Tape 14 can be placed on any area of gutter guard 12 or on any area of any gutter guard.

Any of the patterns, shapes, elements, or screens disclosed within this disclosure as well as any other pattern, shape or element may be utilized as elements that overlay or underlie portions of screened areas of any gutter guard or may overlay or underlie other portions of any gutter guard.

FIG. 11 shows a screen 5A having an upwardly or downwardly embossed pattern 6E embossed/pressed/formed into screen 5A which can serve as the water receiving area of a gutter guard. In FIG. 11, the particular pattern shown is that of a tire tread. Other such tire tread patterns can be used, a sampling of such patterns 17, 17A, 17B, 17C, 17D, 17E, 17E1 are illustrated in FIGS. 68-74. These types of patterns may be employed as embossments, appliques, attachments, etc., at any location on a screen, including "downstream", i.e., after a copper wire or sequence of wires or copper element or sequence of elements present within or adjacent to the body of a screen. These tire tread patterns 17, 17A, 17B, 176C, 17D, 17E, 17E1 can slow water flow and redirect it downward through a screen into an underlying rain gutter. Tire tread patterns 17, 17A, 17B, 176C, 17D, 17E, 17E1 can also slow water flow and redirect water flowing over mechanically waterproofed areas downward through any open air spaces present in a screen "downstream" of mechanically water proofed areas. FIGS. 12, 13 show, respectively, the embossed pattern 6E present in the lowermost plane of recessed channel 9 present within screen 5A and on the top of raised corrugation 9A present within screen 5. These patterns can be present in select areas of a screen or may completely cover the screen and they may or may not be made of or contain copper. The patterns themselves may or may not be made of or contain copper.

Figure 66:
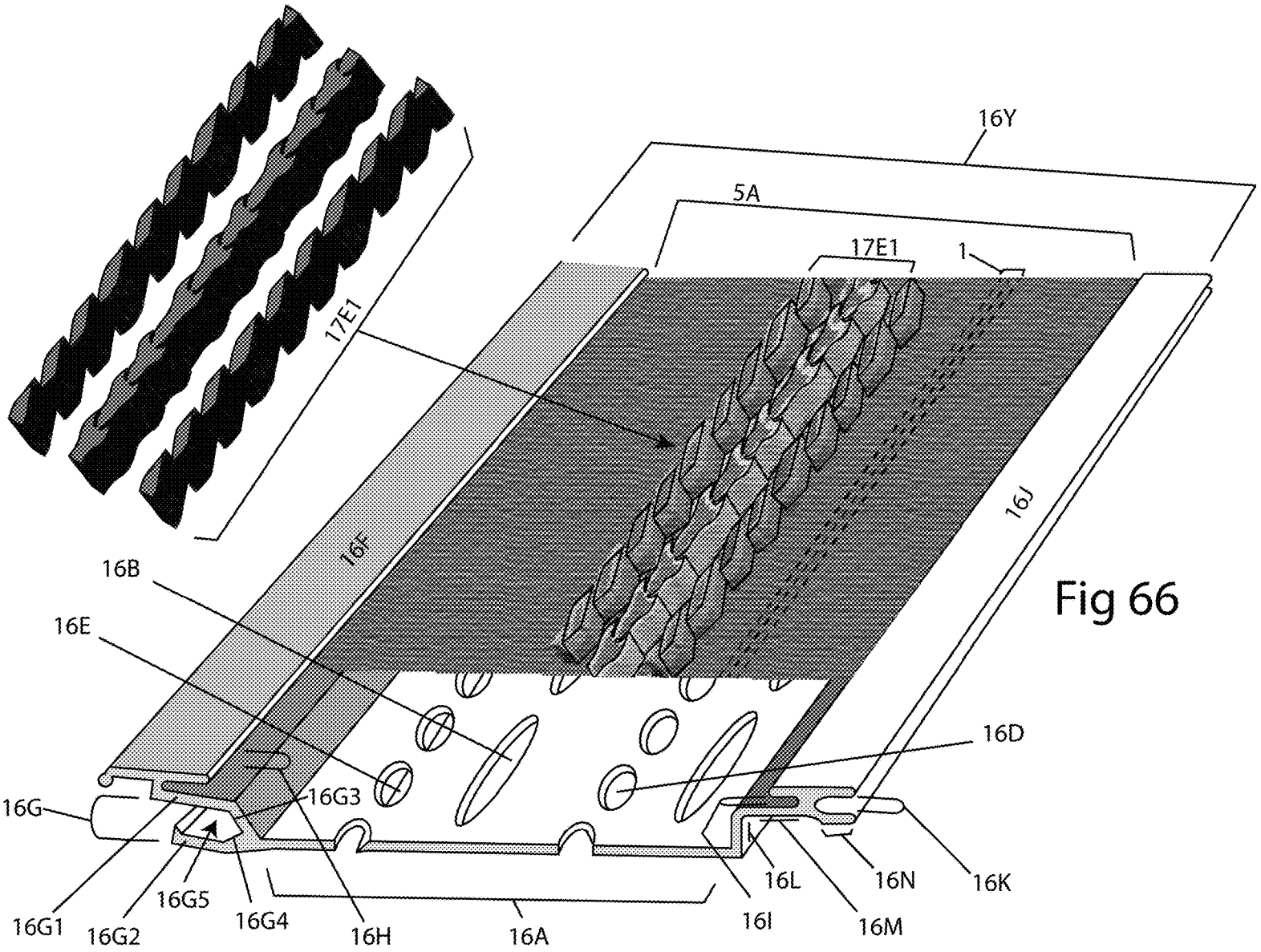
FIG. 66 is a perspective view of exemplary embodiments of the invention.

FIG. 66 shows a gutter guard 16Y having a tire tread pattern 17E1 embossed upwardly or downwardly into the body of screen 5A that overlies perforated lower plane 16A of gutter guard 16Y and that serves as the debris screening/water receiving area of gutter guard 16Y. Screen 5A is shown having copper threads 1 preceding embossed shape 17E1. The gutter guard body has T-shaped first member 16F that overlies and adjoins a modified U-shaped lower member 16G having an upper plane 16G1, a lower plane 16G2, and two rear sidewalls 16G3 and 16G4. U-shaped lower member 16G includes a channel 16G5 that is configured to receive a downward angling plane present at the rear of the top lip of some rain gutters such as, for example, K-style gutters for securing gutter guard 16Y to the top front lip of the gutter. U-shaped lower member 16G adjoins perforated plane 16A which has in a rear portion an upward extending plane 16L that adjoins a lateral plane 16M. Lateral plane 16M adjoins a T-shaped member 16J which has an extending lateral plane 16N. A receiving channel 16K is located above lateral plane 16N. Receiving channel 16K can have flat planes or various shaped elements inserted into it that enable gutter guard 16Y to be secured or adjoined or made adjacent to a fascia board of a building or that may enable the gutter guard to be secured to or rest upon the sub-roof or other structure of a building.

Figure 67:
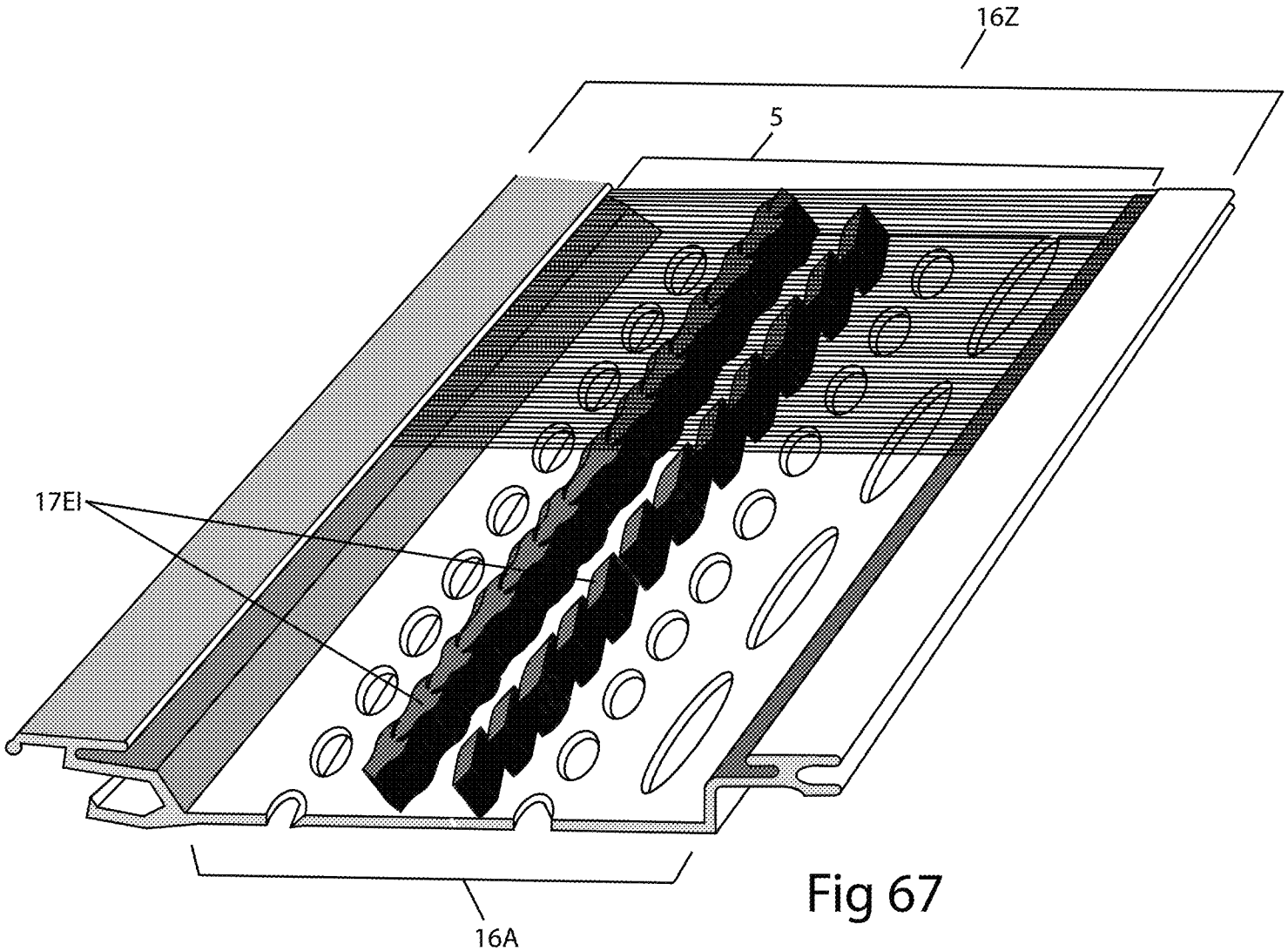
FIG. 67 is a perspective view of exemplary embodiments of the invention.
Figure 70:
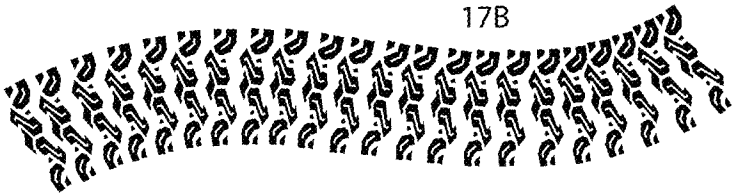
FIG. 70 shows an exemplary embodiment of a pattern in accordance with embodiments of the invention.
Figure 69:
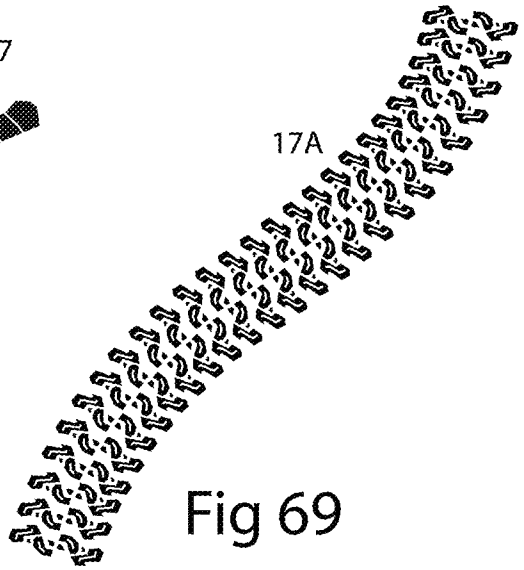
FIG. 69 shows an exemplary embodiment of a pattern in accordance with embodiments of the invention.
Figure 68:
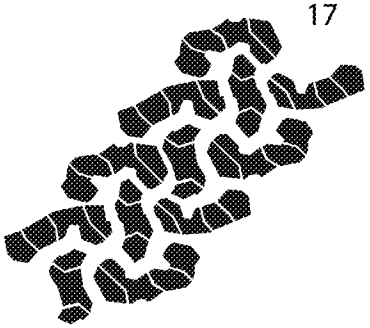
FIG. 68 shows an exemplary embodiment of a pattern in accordance with embodiments of the invention.
Figure 73:
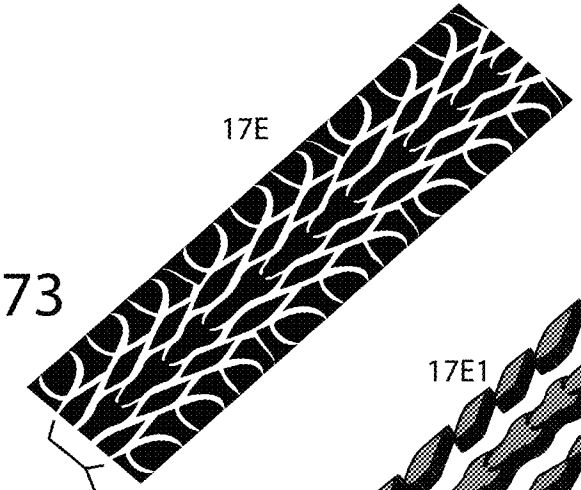
FIG. 73 shows an exemplary embodiment of a pattern in accordance with embodiments of the invention.
Figure 74:
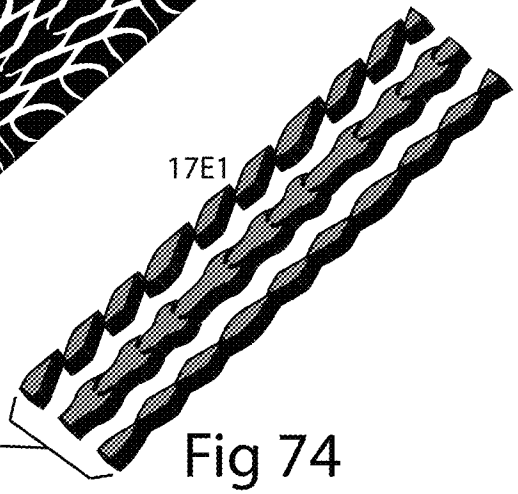
FIG. 74 shows an exemplary embodiment of a pattern in accordance with embodiments of the invention.
Figure 71:
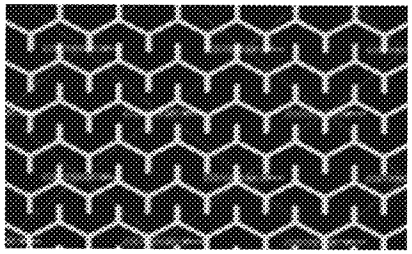
FIG. 71 shows an exemplary embodiment of a pattern in accordance with embodiments of the invention.
Figure 72:
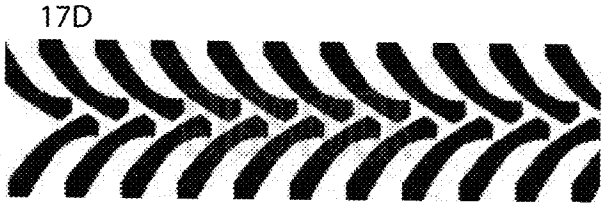
FIG. 72 shows an exemplary embodiment of a pattern in accordance with embodiments of the invention.

FIG. 67 shows a gutter guard 16Z having tire tread structures 17E1 rising upward from the perforated plane 16A of gutter guard 16Z. In some embodiments, such tire tread structures can be made of, coated with, overlain with, or contain, copper and can serve to support an overlying screen.

Figure 75:
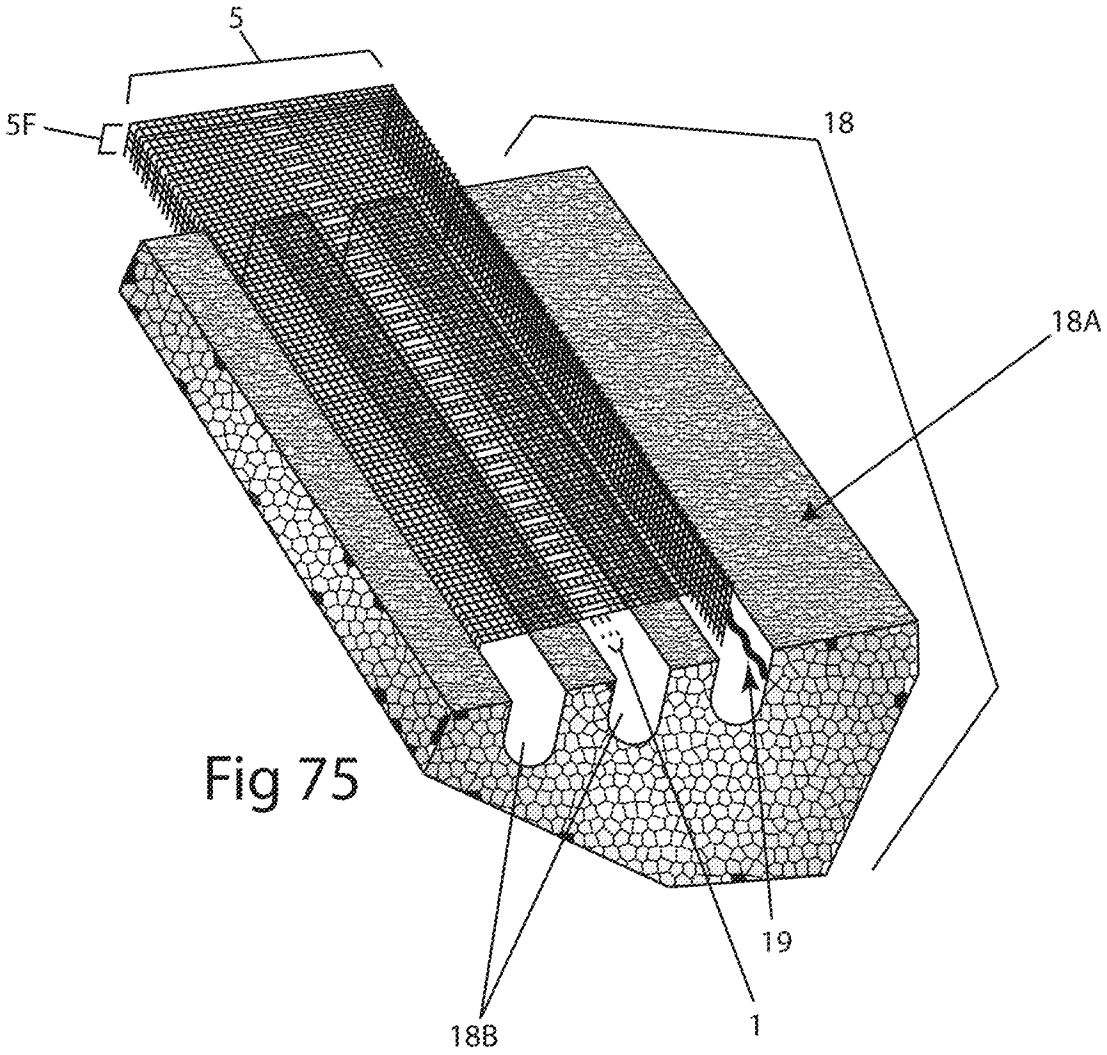
FIG. 75 is a perspective view of exemplary embodiments of the invention.
Figure 75A:
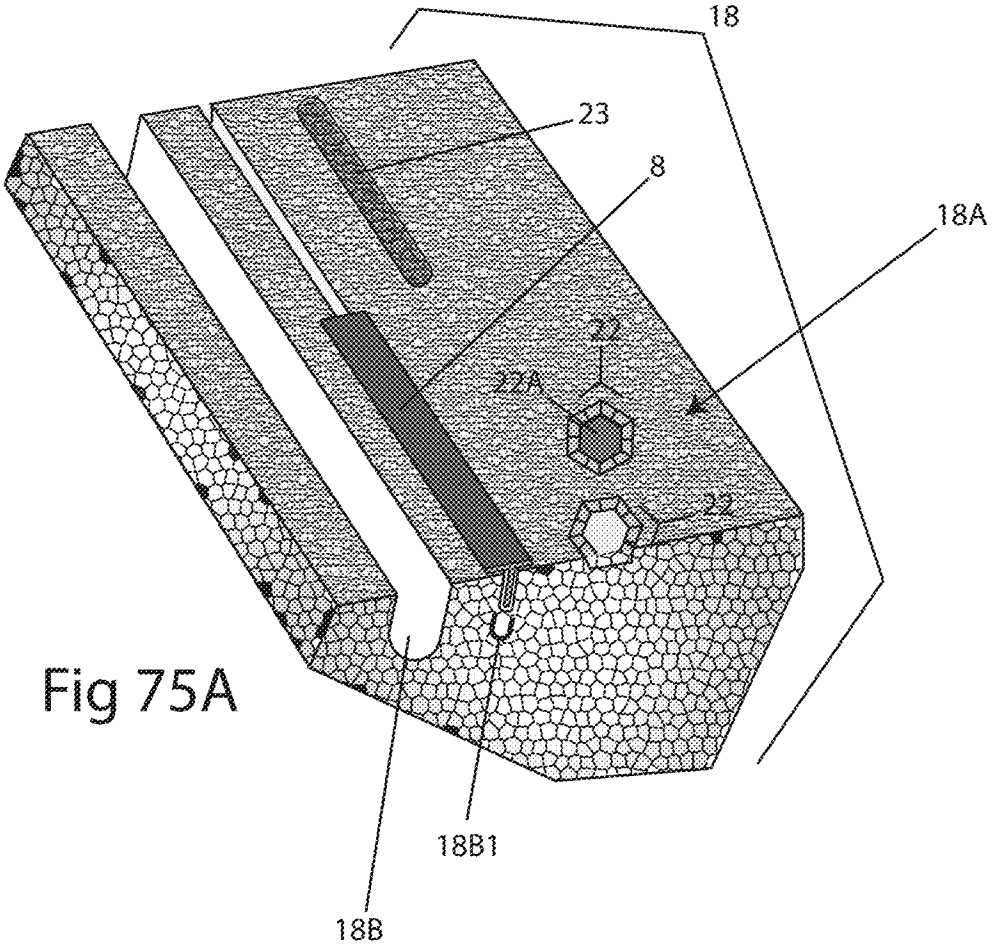
FIG. 75A is a perspective view of exemplary embodiments of the invention.
Figure 75B:
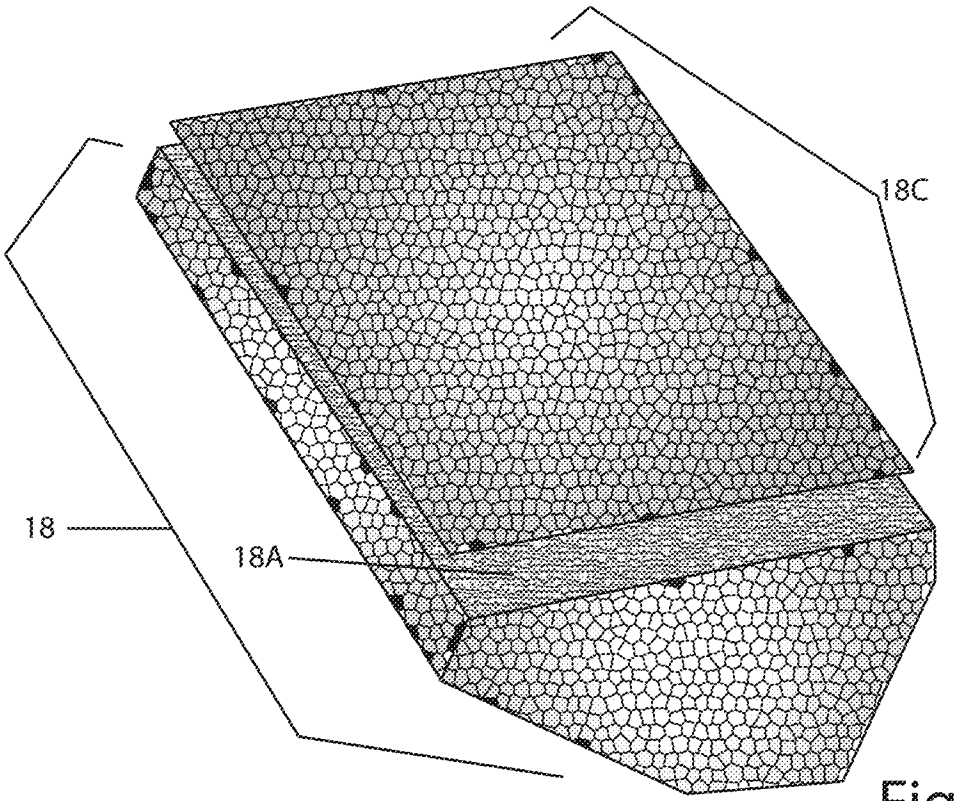
FIG. 75B is a perspective view of exemplary embodiments of the invention.

FIG. 75 shows a gutter guard 18 including a non-woven lofty fiber having channels 18B into which are inserted downward extending sides 5F of a screen 5. Channels 18B or sidewalls 5F of screen 5 can have an adhesive present to further secure screen 5 in place. FIG. 75A shows gutter guard 18 including a non-woven lofty fiber having shaped recessed wells 22 with shaped inserts 22A present in its body. Also shown is an insert 8 inserted into a narrow receiving channel 18B1 present within the body of gutter guard 18. Also shown is an area of a top surface 18A of gutter guard 18 having an area of adhesive 23 sprayed or otherwise attached or affixed to top surface 18A which can be coated with copper (or other) powder or particles that can be, for example, applied by spraying, brushing, or sprinkling. FIG. 75B shows gutter guard 18 including a non-woven lofty fiber having a copper (or other material) tangled mesh type overlay 18C that can be placed upon or attached to top surface 18A by adhesion, mechanical fastening, or other fastening methods. Tangled mesh type overlay 18C can be made of copper, copper and at least one other material, non-woven extruded lofty fibers, or some other material. Copper tangled mesh 18C may alternately be comprised of non-woven-extruded-lofty-fibers that have been sprayed with adhesive and coated with copper powder or elements. As in gutter guard 18, a screen or solid element of any material, shape or configuration can be over the top or embedded within the top, or portions of the top, surface of any gutter guard's non-woven lofty fiber's top surface irrespective of any channels or other features that may or may not be present within the non-woven lofty fiber.

Figure 79:
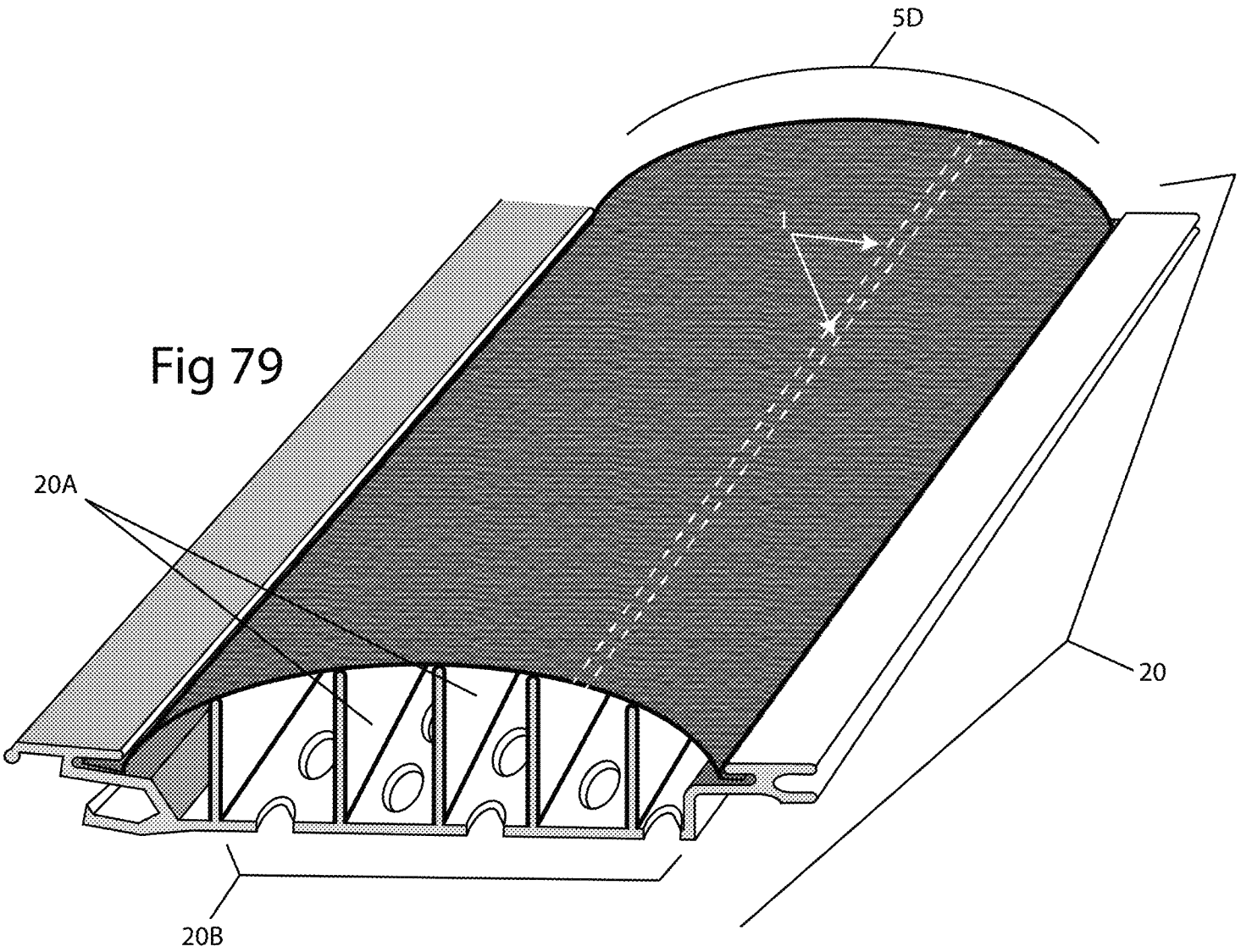
FIG. 79 is a perspective view of exemplary embodiments of the invention.

FIG. 79 shows a gutter guard 20 having upwardly raised elements 20A of a length rising upward out of a perforated lower plane 20B of gutter guard 20. Although not illustrated, the top of upwardly raised elements 20A may be flat, triangular, elongated or of any other shape and are overlain by a screen 5D that follows or mostly follows the contour created by the upwardly raised elements 20A. In this embodiment, screen 5D has larger or harder threads or a braid of threads 1 as shown. Screen 5D can touch or be in close proximity to the top of upwardly raised elements 20A and can deviate in direction between upwardly raised elements 20A. Although not illustrated, upwardly raised elements 20A can form a concave or flat or other dimensioned support area for overlying screen 5D.

Figure 80:
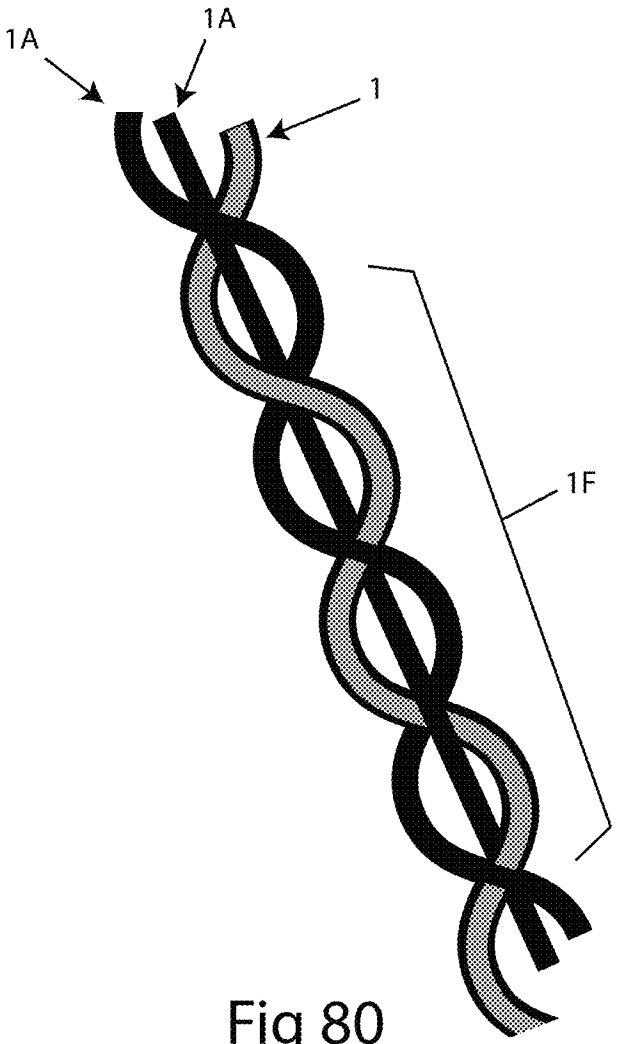
FIG. 80 is a perspective view of exemplary embodiments of the invention.

FIG. 80 shows braided wires or threads 1F. Braid 1F may be substituted for any wire in any screen in this disclosure. Braid 1F is shown having a larger or harder thread or a braid of thread 1 interwoven or braided with smaller threads 1A. Braid 1F may serve some of the purposes of a corrugation such as stiffening a screen against convexing or concaving under stress when braid 1F is used as a weft or transverse directioned thread as illustrated in FIG. 77. In addition to the FIG. 77 configuration showing braid 1F in a transverse direction, braid 1F may extend in any other possible direction within or on the body of any screen. Wires that make up braid 1F may be of any count, any hardness, any material, and in any proximity to one another. Braided threads can be a separate part from screen 55 but placed in close proximity over or under screen 5 and either touching or not touching screen 5.

Figure 81:
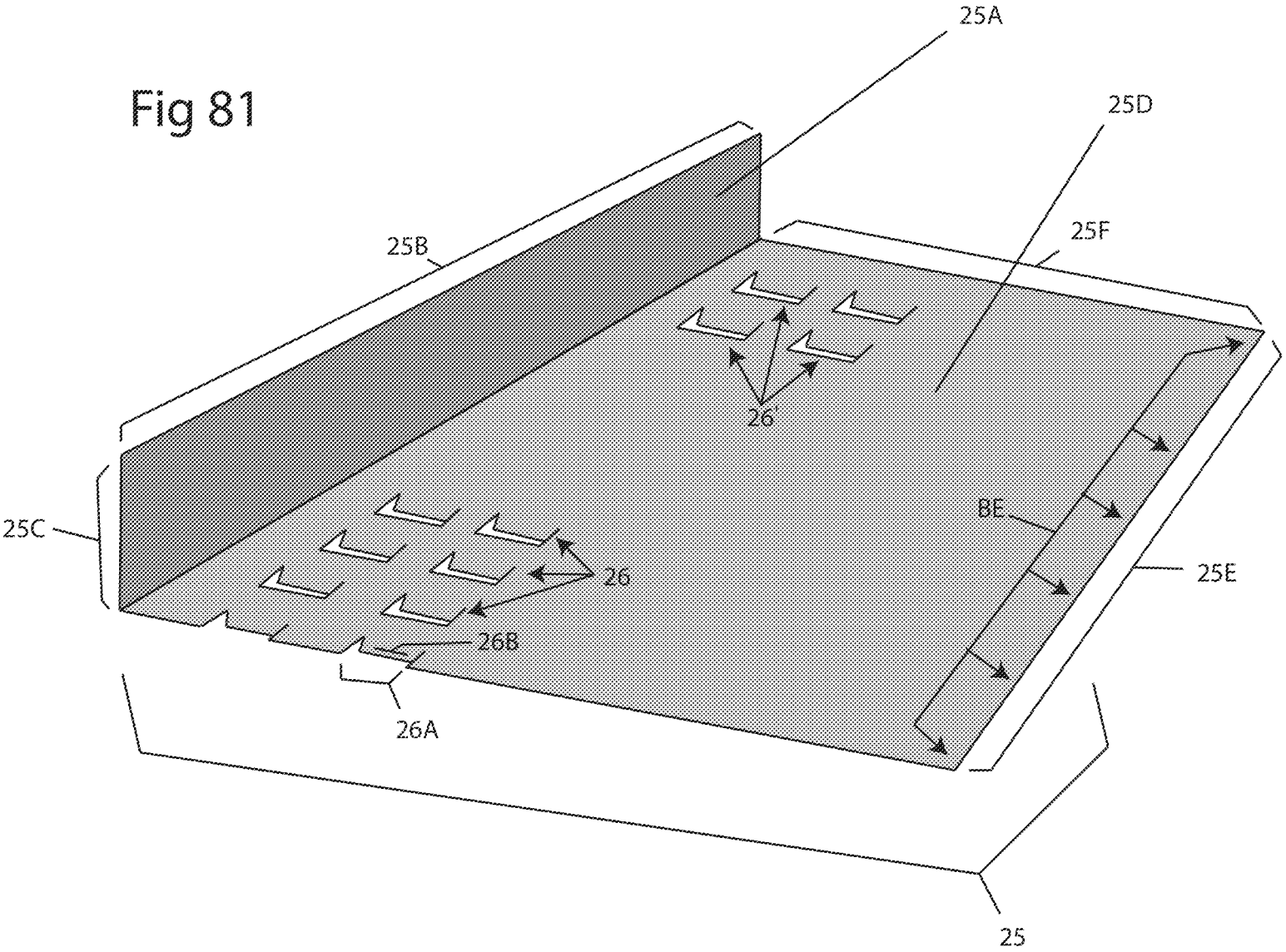
FIG. 81 is a perspective view of a water diverter in accordance with exemplary embodiments of the invention.

FIG. 81 shows an example of a water diverter 25 having an upward extension 25A and a rearward extension 25D. Upward extension 25A has both a width 25B and a height 25C that are subject to no limitations. Rearward extension 25D has both a width 25E and a length 25F that are subject to no limitations. In embodiments, upward extension forms a first angle with rearward extension 25D of, for example, between 26 degrees and 85 degrees. Although upward extension 25A and rearward extension 25D are planar in this example, upward extension 25A and/or rearward extension 25D can have shapes other than planes.

In some instances where water flow is intended to be directed leftward, in some embodiments louvered openings 26 are present on the left side of rearward extension 25D. In the example shown, louvered openings 26 have an open airspace 26A into which distends a downward extension 26B.

Louvered openings 26 present in rearward extension 25D aid in lowering the height of water streams flowing onto the diverter thereby preventing water overflowing the top of upward extension 25A and rushing downward and forward (into the very area from which diverter 25 is designed to divert water). Uniformly sized louvered openings being present throughout rearward extension 25D would allow water to travel forward from beneath the entire width 25E of rearward extension 25D, defeating the purpose of the diverter. Particular embodiments of the invention provide louvers only on one side (the left or right side) of rearward extension 25D. Other embodiments provide louvers of differing sizes all the way across rearward extension 25D. In embodiments, a first group of openings 26 is located in a first half of rearward extension 25D, a second group of the openings 26' is located in a second half of rearward extension 25D. In embodiments, a total open area of the first group or openings 26 is greater than a total open area of the second group of openings 26'. Other types of louvers or perforations can be used in rearward extension 25D in lieu of the specific type of louvered opening 26 shown in FIG. 81. In some embodiments, upward extension 25A includes one or more openings to allow water to flow through upward extension 25A.

Figure 86:
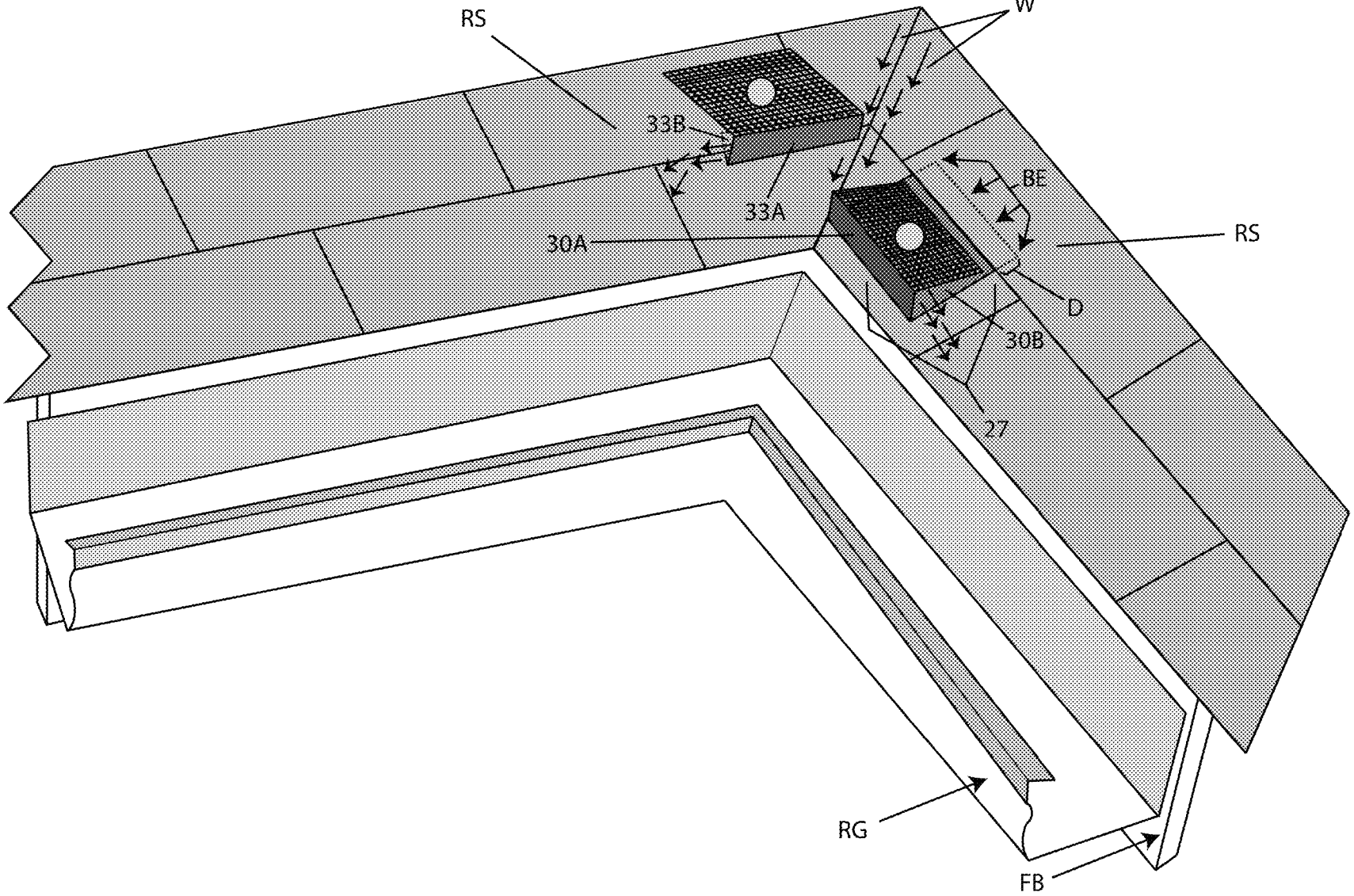
FIG. 86 is a perspective view of water diverters in accordance with exemplary embodiments of the invention.

In embodiments, installation of water diverter 25 may be accomplished by inserting a rear edge BE of rearward extension 25D beneath the front edge of a roof shingle RS in similar fashion to that of water diverter 27 shown in FIG. 86.

Figure 82:
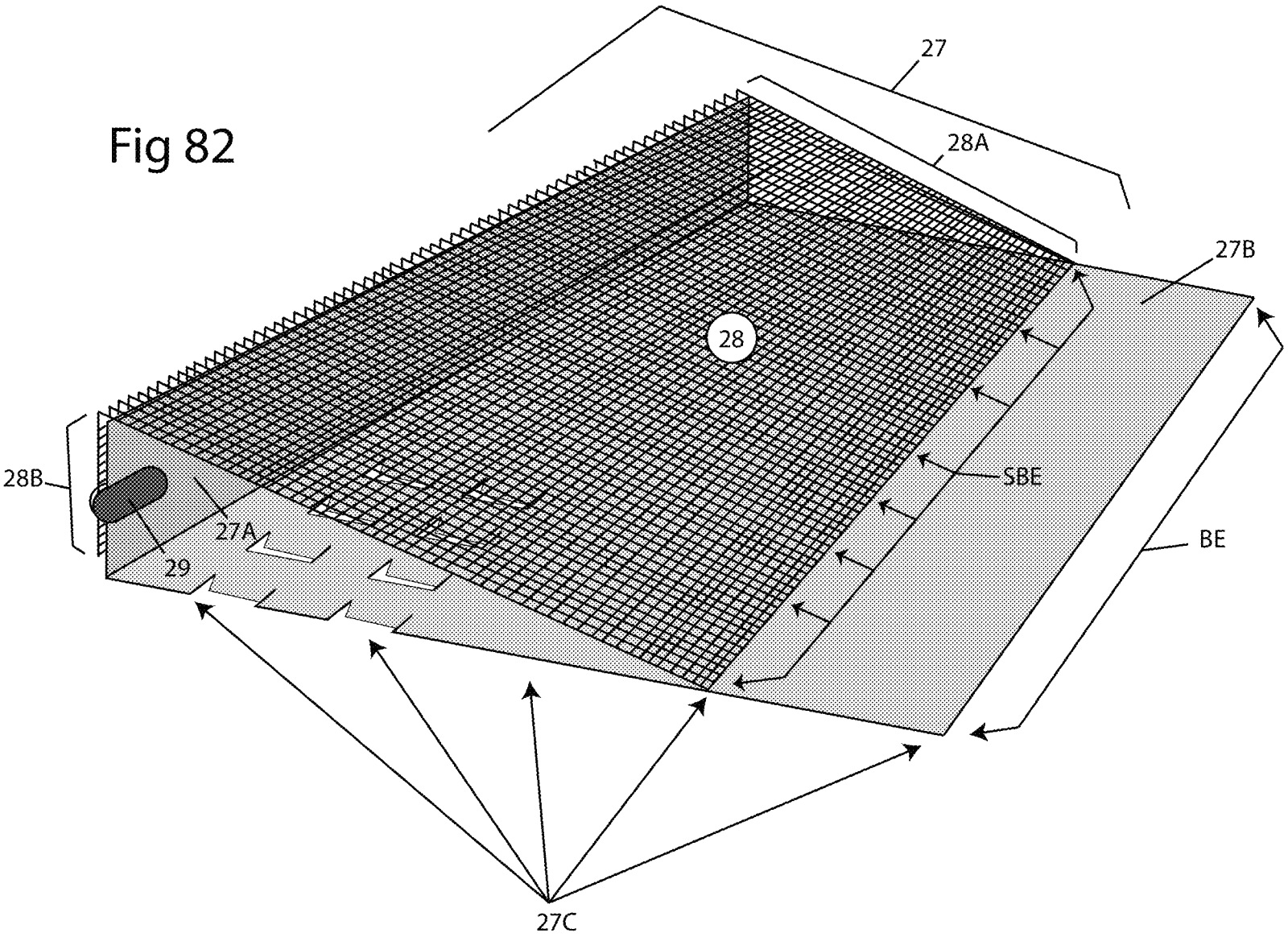
FIG. 82 is a perspective view of a water diverter in accordance with exemplary embodiments of the invention.

FIG. 82 shows a water diverter 27 having an upward extension 27A, a rearward extension (attachment portin) 27B, and a screen 28. Screen 28 has a rear section 28A that serves as a debris-shedding and water receiving area of diverter 27, and a forward and downward extending section 28B that may be placed adjacent to a first (front) or a second (rear) surface of upward extension 27A. Section 28B can be attached to upward extension 27A by a clip 29 or by adhesives, sintering or other methods. Screen 28 has a rear edge SBE that can rest on any portion of rearward extension 27B depending on the width of screen 28. Rear section 28A angles downward toward rearward extension 27B of water diverter 27. In embodiments, upward extension 27A forms a first angle with rearward extension 27B of, for example, between 26 degrees and 85 degrees. In embodiments, screen 28 forms an included second angle with upward extension 27A. In embodiments, the second angle is greater than zero degrees. In embodiments, the second angle is between 85 degrees and 95 degrees. In embodiments, a third angle between rearward extension 27B and the surface of screen 28 in the transverse direction is less than 90 degrees.

Screen 28 prevents some or all debris from lodging behind upward extension 27A and gradually forming a large debris mat on and behind diverter 27.

In particular embodiments, installation of water diverter 27 is accomplished by inserting its rear edge BE beneath the front edge of a roof shingle RS as shown, for example, in FIG. 86. FIG. 86 shows rear edge BE inserted to a point where spots of adhesive roof tar (that typically exist on the underneath of a shingle) will rest on top of rearward extension 27B, thereby securing it in place. In the event a shingle cannot be lifted to allow the insertion of extension 27B beneath the shingle, an adhesive liquid, paste, or tape may be used on any portion or portions of the underside of rearward extension 27B to secure it to the top surface of one or more shingles.

Figure 83:
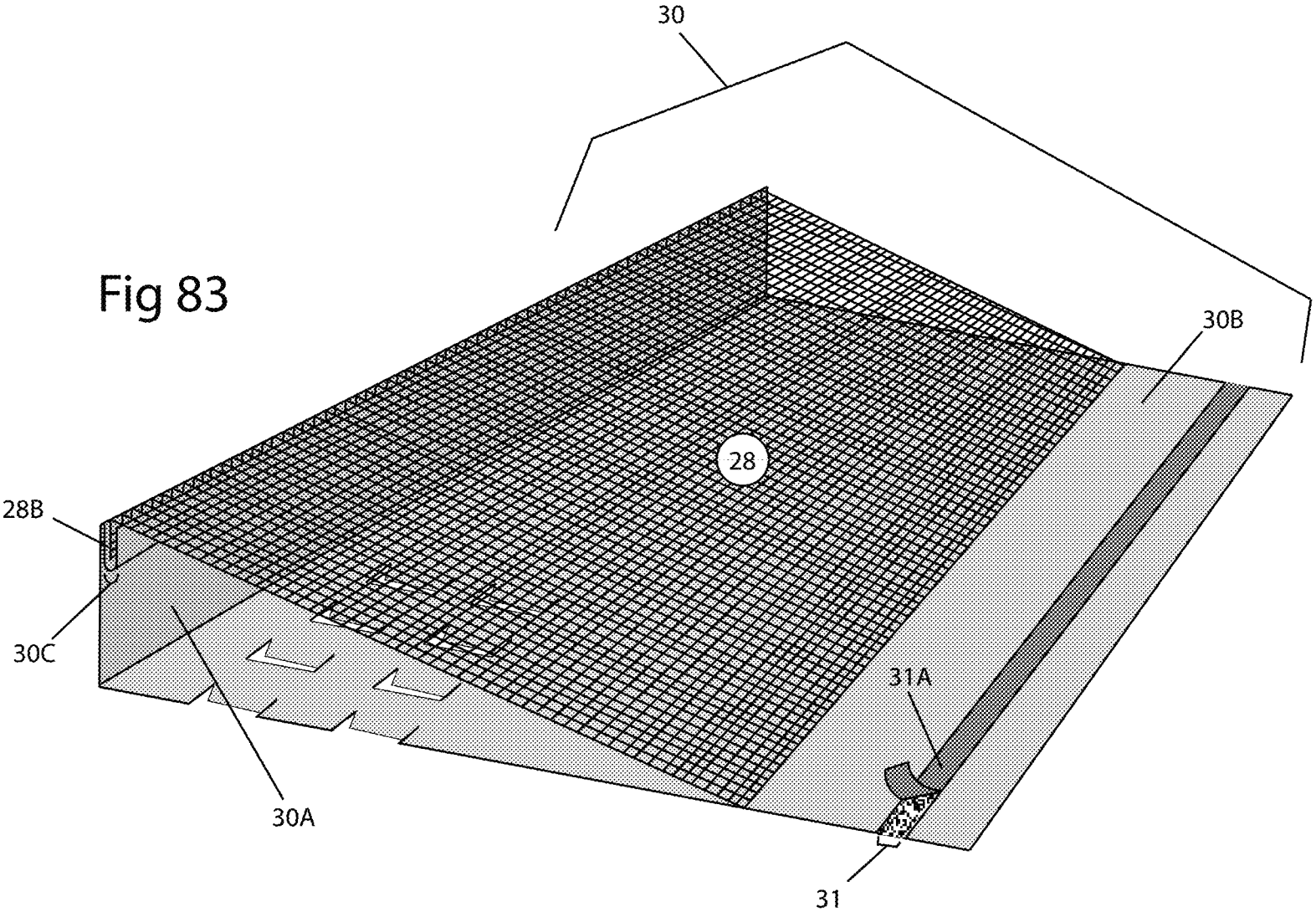
FIG. 83 is a perspective view of a water diverter in accordance with exemplary embodiments of the invention.

FIG. 83 shows an example of a water diverter 30 having a screen-edge receiving channel 30C that is a part of an upward extension 30A. In other embodiments, channel 30C is a separate element fixed to upward extension 30A. Receiving channel 30C is used to receive and secure section 28B of screen 28.

FIG. 83 shows an adhesive glue or tape 31 with a peelable plastic covering 31A. At the time of installation of water diverter 30, peelable plastic covering 31A is removed to expose adhesive 31. Such an adhesive helps to further secure rear extension 30B beneath an overlying shingle when the bottom surface of the overlying shingle is pressed down onto adhesive 31.

Figure 84:
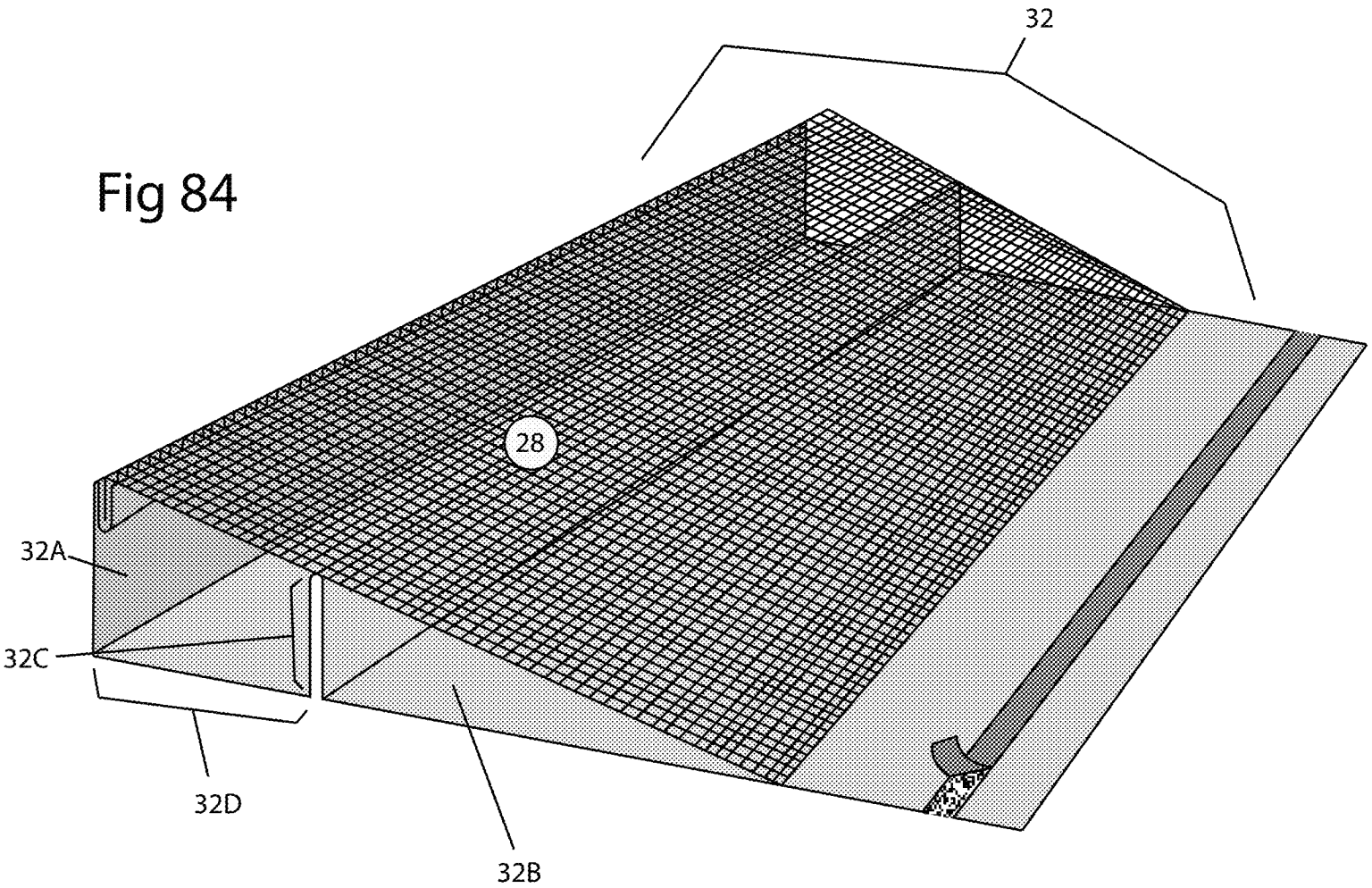
FIG. 84 is a perspective view of a water diverter in accordance with exemplary embodiments of the invention.

FIG. 84 shows a water diverter 32 having an upward extending element 32C that serves in conjunction with upward extension 32A to form a water directing channel 32D. In some embodiments, upward extending element 32C supports overlying screen 28 to strengthen screen 28 against concavity.

Figure 85:
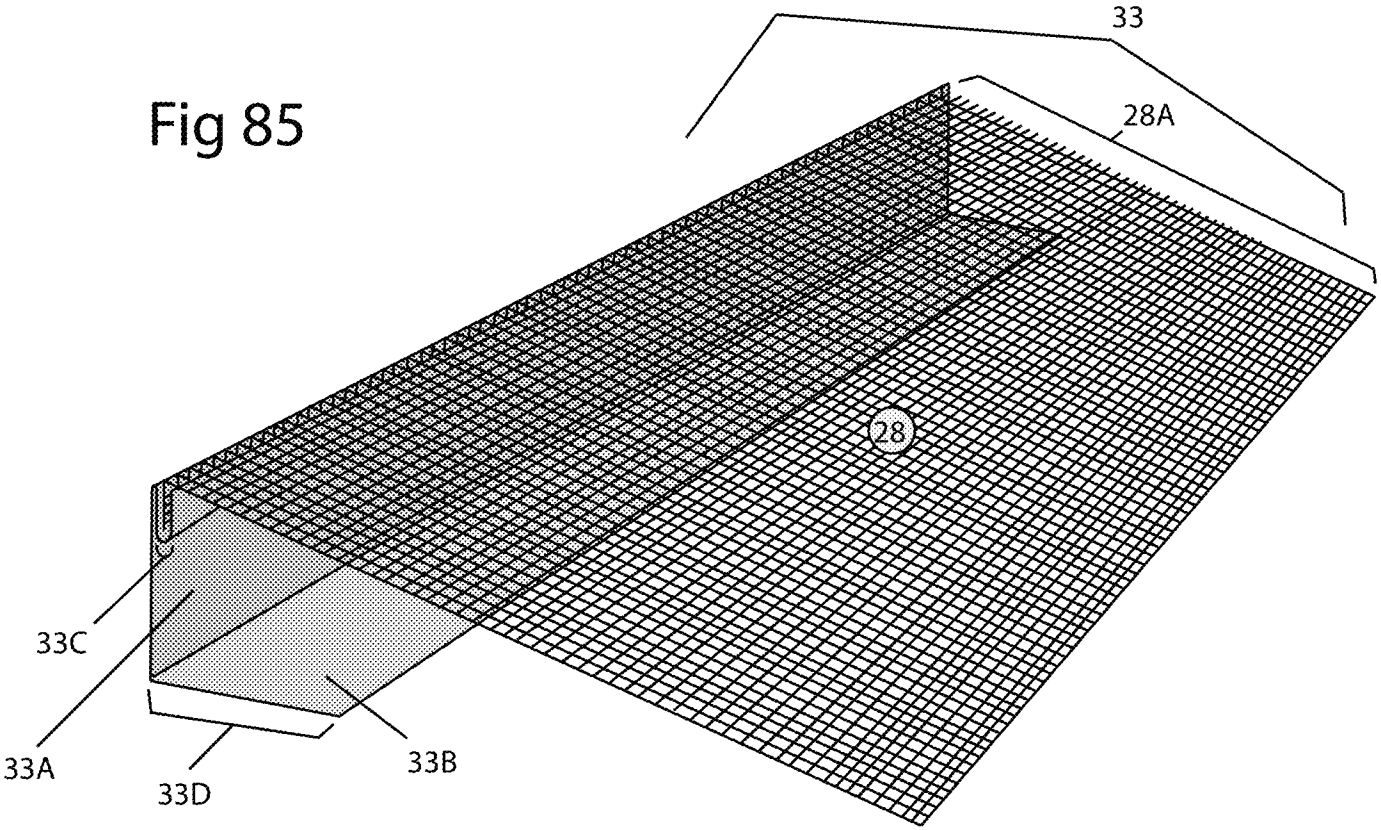
FIG. 85 is a perspective view of a water diverter in accordance with exemplary embodiments of the invention.

FIG. 85 shows a water diverter 33 having an upward extension 33A, a screen receiving channel 33C, and a short rearward extension 33B with a width 33D that is less than the width of water receiving portion 28A of screen 28 overlying it.

Features or elements shown in FIGS. 81 through 85 are interchangeable among embodiments of the invention. Other common methods of attachment (not shown) may also be used to secure screens to other portions of the water diverters.

FIG. 86 shows water diverters 30 and 33 installed on a shingled roof near a roof valley by having rear edge BE of their rearward extensions 30B and 33B inserted beneath overlying shingles RS. FIG. 86 shows diverters 30 and 33 installed above a rain gutter RG that is attached to a fascia board FB of a building. In various embodiments, rear edge BE is inserted different distances D beneath a shingle. Water W coming down a roof is intercepted by a water diverter's upward extension (such as 30A and 33A) and then channeled away from the roof valley and out the opposite end of the diverter (shown by arrows in FIG. 86). Channeling may be increased by slightly tilting the water diverter to the left or right in relation to the front edge of the shingle or shingles it is installed beneath. Water diverters may be used on any area of the roof and may be installed on roofs employing shingles, metal, shakes, or any other type roof covering by use of insertion beneath a roof element, by means of adhesion, welding, soldering, or other means of fastening.

Embodiments of the invention disclose that any screen of any construction (with or without corrugations, with or without embossed or embedded patterns or shapes, with or without intrinsically woven, threaded, knitted, or attached patterns or shapes, with or without coatings) that may or may not have larger or harder threads or a braid of threads (or copper properties) in or on portions of the screen or in or on the screen in its entirety may be sized and shaped to fit over or under or in line with or be made adjacent to or attached to any part of any type of gutter guard in any direction and need not completely extend across the screen.

Embodiments of the invention disclose that any copper element or copper containing mixture, adhesive, powder, or paint can be applied to any element and area of a gutter guard.

Embodiments of the invention disclose that larger or harder threads or a braid of threads can be incorporated into any element and area of a gutter guard.

Embodiments of the invention disclose that a wire or wires of any length and having a greater hardness or strength may be woven, or otherwise placed in or on any portion of a screen in any direction to strengthen the screen against convexing or concaving or both.

Embodiments of the invention disclose that wires of the same or mixed composition may be braided and may be woven, or otherwise placed in, on, or under any portion of a screen in any direction to strengthen the screen against convexing or concaving or both.

Embodiments of the invention combine any or all of the protrusion and/or dimensional features disclosed with the various diverter embodiments.

Embodiments of the invention disclose that non-woven lofty fiber or metallic tangled mesh screens may be comprised of threads of differing materials.

Embodiments of the invention disclose a porous material of some volume placed on, or in the space above, the rearward extension 25D, for example. For example, a sponge or other porous material having a triangular cross-section can be placed in the space created by, for example, rearward extension 25D and upward extension 25A. In some embodiments, the porous material touches one or both of rearward extension 25D and upward extension 25A. In some embodiments, the porous material does not come in contact with one or either of rearward extension 25D and upward extension 25A. While rearward extension 25D and upward extension 25A are used as examples in this paragraph, a porous material can be used in a similar way in the other embodiments of the invention shown in this disclosure.

While many of the examples shown use a screen that has threads that extend in directions parallel and perpendicular to a longitudinal direction of the gutter guard or an edge of a gutter, other embodiments of the invention use a screen that has threads that extend in directions that are at an acute angle to a longitudinal direction of the gutter guard or an edge of a gutter. Some embodiments use a screen in which the threads are not orthogonal to one another. Some embodiments use a screen in which the threads are not orthogonal to one another and all threads are at an acute angle to a longitudinal direction of the gutter guard or an edge of a gutter. In some applications, screens with threads that are at an acute angle to a longitudinal direction of the gutter guard or an edge of a gutter pass more water through the screen than screens with similarly spaced threads that are parallel and perpendicular to the longitudinal direction of the gutter guard or an edge of a gutter.

While some of the examples shown larger or harder threads or a braid of threads grouped together in the screen, other examples space a single larger or harder thread or a braid of threads among smaller and/or softer threads. In embodiments, a single (or some other number) of larger or harder threads or a braid of threads are evenly (or unevenly) spaced among a number of smaller and/or softer threads. In some applications, this can reduce the amount or existence of mechanical waterproofing and/or strengthen the screen against concaving or convexing.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents. In addition, all combinations of any and all of the features described in the disclosure, in any combination, are part of the invention. The choice of words used for the description of an element is one of many common words that could have been chosen and thus the word is not meant to impact the intent what the element was intended to do.

What is claimed is:

1. A water diverter for diverting water on a building roof, the diverter comprising:

a main body having a first portion having a top side and a bottom side, a diverting portion extending from the top side of the first portion at a first angle, the first angle being an angle greater than zero degrees, and an attachment portion extending from the first portion and being configured to attach to the building roof;

a first opening in the first portion, the first opening being configured to allow the water to pass through the first portion;

an extension extending from the bottom side of the first portion, the extension being configured to elevate the bottom side of the first portion above the roof to create a space between the bottom side of the first portion and the roof; and a filter element positioned above the first portion of the main body and through which the water can pass; and wherein the extension is a bottommost extremity of the water diverter.

2. The diverter of claim 1, wherein the diverting portion extends in a longitudinal direction parallel to a junction between the diverting portion and the first portion of the main body, the first portion of the main body has a longitudinal direction parallel to the longitudinal direction of the diverting portion, and a transverse direction perpendicular to the longitudinal direction of the first portion, the first portion has a first half and a second half along the longitudinal direction, a boundary between the first half and the second half extending in the transverse direction, and the first opening is located in the first half of the first portion.

3. The diverter of claim 1, wherein the diverting portion extends in a longitudinal direction parallel to a junction between the diverting portion and the first portion of the main body, the first portion of the main body has a longitudinal direction parallel to the longitudinal direction of the diverting portion, and a transverse direction perpendicular to the longitudinal direction of the first portion, the first portion has a first half and a second half along the longitudinal direction, a boundary between the first half and the second half extending in the transverse direction, a first group of openings is located in the first half of the first portion, the first group of openings including the first opening, a second group of the openings is located in the second half of the first portion, and a total open area of the first group of openings is greater than a total open area of the second group of openings.

4. The diverter of claim 1, wherein the first angle is between 26 degrees and 85 degrees.

5. The diverter of claim 1, wherein the filter element forms an included second angle with the diverting portion of the main body, the second angle being an angle greater than zero degrees.

6. The diverter of claim 1, further comprising an adhesive strip on the attachment portion, the adhesive strip being configured to adhere the attachment portion to the roof.

7. The diverter of claim 1, further comprising an upwardly extending element protruding from the first portion of the main body toward the filter element.

8. The diverter of claim 7, wherein the upwardly extending element contacts the bottom side of the filter element.

9. A water diverter for diverting water on a building roof having a roof covering, the diverter comprising:

a main body having a first portion having a top side and a bottom side, the first portion having an opening configured to allow the water to pass through the first portion, the first portion being configured to position the opening over the roof covering;

an attachment portion extending from the first portion, the attachment portion being configured to attach to the building roof under the roof covering, an extension extending from the bottom side of the first portion, the extension being configured to elevate the bottom side of the first portion above the roof covering such that there is a space between the bottom side of the first portion and the roof covering, and a diverting portion extending from the top side of the first portion at a first angle, the first angle being an angle greater than zero degrees; and a filter element positioned above the first portion and through which the water can pass; and wherein the extension is a bottommost extremity of the water diverter.

10. The diverter of claim 9, wherein a surface of the filter element forms an included second angle with the diverting portion of the main body, the second angle being an angle greater than zero degrees.

11. The diverter of claim 10, wherein the second angle is between 85 degrees and 95 degrees.

12. The diverter of claim 9, wherein the diverting portion extends in a longitudinal direction parallel to a junction between the diverting portion and the first portion, the first portion has a longitudinal direction parallel to the longitudinal direction of the diverting portion, and a transverse direction perpendicular to the longitudinal direction of the first portion, the first portion and the attachment portion extend collectively in the transverse direction a first distance, the filter element extends in the transverse direction a second distance, and the second distance is shorter than the first distance.

13. The diverter of claim 12, wherein the first portion is planar, a surface of the filter element is planar, and a third angle between the first portion and the surface of the filter element in the transverse direction is less than 90 degrees.

14. The diverter of claim 9, wherein the first portion is planar, a surface of the filter element is planar, and a third angle between the first portion and the surface of the filter element in the transverse direction is less than 90 degrees.

15. A roof for a building, comprising:

a first roof surface; and a diverter having a main body having a first portion having a top side and a bottom side, the bottom side resting on the first roof surface, a diverting portion extending from the top side of the first portion at a first angle, the first angle being an angle greater than zero degrees, and an attachment portion extending from the first portion and attached to the roof such that an entirety of the first portion is above the first roof surface, and a filter element positioned above the first portion of the main body and through which the water can pass.

16. The roof of claim 15, further comprising an opening in the first portion, the opening being configured to allow water to pass through the first portion.

17. The roof of claim 15, further comprising a second roof surface; and a valley formed by the first roof surface intersecting with the second roof surface, wherein an edge of the diverter is located in the valley.

18. The roof of claim 15, wherein the diverting portion extends in a longitudinal direction parallel to a junction between the diverting portion and the first portion.

19. The roof of claim 15, further comprising an opening in the diverting portion, the opening being configured to allow water to pass through the diverting portion.

20. The diverter of claim 1, wherein the extension is a louver directly adjacent the first opening.

* * * * *